US011313243B2

(12) United States Patent
Shi et al.

(10) Patent No.: US 11,313,243 B2
(45) Date of Patent: Apr. 26, 2022

(54) NON-CONTINUOUS ABRADABLE COATINGS

(71) Applicants: Rolls-Royce North American Technologies, Inc., Indianapolis, IN (US); Rolls-Royce Corporation, Indianapolis, IN (US)

(72) Inventors: Jun Shi, Carmel, IN (US); Matthew R. Gold, Carmel, IN (US)

(73) Assignees: Rolls-Royce North American Technologies, Inc., Indianapolis, IN (US); Rolls-Royce Corporation, Indianapolis, IN (US)

( * ) Notice: Subject to any disclaimer, the term of this patent is extended or adjusted under 35 U.S.C. 154(b) by 296 days.

(21) Appl. No.: 16/510,184

(22) Filed: Jul. 12, 2019

(65) Prior Publication Data

US 2020/0277871 A1 Sep. 3, 2020

Related U.S. Application Data

(60) Provisional application No. 62/697,076, filed on Jul. 12, 2018.

(51) Int. Cl.
*F01D 11/12* (2006.01)

(52) U.S. Cl.
CPC ..... *F01D 11/122* (2013.01); *F05D 2230/31* (2013.01); *F05D 2240/11* (2013.01); *F05D 2240/30* (2013.01); *F05D 2240/55* (2013.01); *F05D 2300/6033* (2013.01)

(58) Field of Classification Search
CPC ..... F01D 11/122; F05D 2240/30; F05D 2230/31; F05D 2240/55
See application file for complete search history.

(56) References Cited

U.S. PATENT DOCUMENTS

| | | | |
|---|---|---|---|
| 4,346,904 | A | 8/1982 | Watkins, Jr. |
| 4,466,772 | A | 8/1984 | Okapuu et al. |
| 5,951,892 | A | 9/1999 | Wolfla et al. |
| 5,951,982 | A | 9/1999 | Zoller et al. |
| 6,102,656 | A | 8/2000 | Nissley et al. |

(Continued)

FOREIGN PATENT DOCUMENTS

| | | | |
|---|---|---|---|
| CN | 103980681 | A | 8/2014 |
| DE | 102016110337 | A1 | 12/2017 |

(Continued)

OTHER PUBLICATIONS

U.S. Appl. No. 16/144,235, filed Sep. 27, 2018, by Sippel et al.

(Continued)

*Primary Examiner* — Brian P Wolcott
(74) *Attorney, Agent, or Firm* — Shumaker & Sieffert, P.A.

(57) ABSTRACT

In some examples, a component includes a substrate and a non-continuous abradable coating on the substrate. The abradable coating includes a first portion defining a first plurality of coating blocks, a second portion defining a second plurality of coating blocks, and a blade rub portion extending between the first portion and the second portion and defining a third plurality of coating blocks. At least one of the first plurality of coating blocks or the second plurality of coating blocks is different than the third plurality of coating blocks in at least one coating block parameter.

20 Claims, 6 Drawing Sheets

(56) References Cited

U.S. PATENT DOCUMENTS

| | | | | |
|---|---|---|---|---|
| 6,203,021 | B1 * | 3/2001 | Wolfla | F16J 15/445 277/415 |
| 6,375,880 | B1 | 4/2002 | Cooper et al. | |
| 6,887,528 | B2 * | 5/2005 | Lau | C23C 4/01 427/448 |
| 7,445,685 | B2 * | 11/2008 | Deakin | C23C 4/02 156/212 |
| 7,686,570 | B2 * | 3/2010 | Allen | F01D 11/125 415/9 |
| 7,686,990 | B2 | 3/2010 | Gray | |
| 8,501,840 | B2 | 8/2013 | Kirby et al. | |
| 8,852,720 | B2 * | 10/2014 | Bolcavage | C23C 4/02 428/167 |
| 9,249,680 | B2 | 2/2016 | Lee et al. | |
| 9,527,242 | B2 | 12/2016 | Rodgers et al. | |
| 9,598,972 | B2 | 3/2017 | Strock | |
| 9,713,912 | B2 * | 7/2017 | Lee | C23C 4/02 |
| 9,797,263 | B2 | 10/2017 | Varney et al. | |
| 9,925,714 | B2 | 3/2018 | Rodgers et al. | |
| 10,132,185 | B2 | 11/2018 | Gold | |
| 10,189,204 | B2 | 1/2019 | Fulop et al. | |
| 10,190,435 | B2 * | 1/2019 | Lee | F01D 11/122 |
| 10,870,152 | B2 * | 12/2020 | Le Biez | B22F 3/105 |
| 2005/0003172 | A1 | 1/2005 | Wheeler et al. | |
| 2005/0173380 | A1 | 8/2005 | Carbone | |
| 2006/0110248 | A1 | 5/2006 | Nelson et al. | |
| 2008/0274336 | A1 | 11/2008 | Merrill et al. | |
| 2010/0003894 | A1 | 1/2010 | Miller et al. | |
| 2010/0320649 | A1 | 12/2010 | Niebling | |
| 2011/0016717 | A1 | 1/2011 | Morrison et al. | |
| 2011/0097538 | A1 | 4/2011 | Bolcavage et al. | |
| 2011/0103940 | A1 * | 5/2011 | Duval | F01D 11/125 415/173.4 |
| 2012/0107103 | A1 * | 5/2012 | Kojima | F01D 11/122 415/173.4 |
| 2013/0017072 | A1 | 1/2013 | Mi et al. | |
| 2014/0154088 | A1 | 6/2014 | Etter et al. | |
| 2014/0294652 | A1 | 10/2014 | Morrison et al. | |
| 2014/0367894 | A1 | 12/2014 | Kramer et al. | |
| 2015/0014885 | A1 | 1/2015 | Hofmann et al. | |
| 2015/0099087 | A1 | 4/2015 | Reznar et al. | |
| 2015/0102531 | A1 | 4/2015 | El-Siblani et al. | |
| 2015/0108095 | A1 | 4/2015 | Kruer et al. | |
| 2015/0354392 | A1 * | 12/2015 | Lipkin | F01D 11/125 415/173.4 |
| 2015/0354393 | A1 | 12/2015 | Lipkin et al. | |
| 2016/0089720 | A1 | 3/2016 | Kamakura et al. | |
| 2016/0130969 | A1 | 5/2016 | Gold | |
| 2016/0236994 | A1 | 8/2016 | Vetters et al. | |
| 2016/0236995 | A1 | 8/2016 | Lai et al. | |
| 2016/0305316 | A1 | 10/2016 | Shomura et al. | |
| 2016/0305319 | A1 | 10/2016 | Baldiga et al. | |
| 2016/0319688 | A1 | 11/2016 | Vetters et al. | |
| 2017/0120528 | A1 | 5/2017 | Tejada Palacios et al. | |
| 2017/0165917 | A1 | 6/2017 | McKiel, Jr. | |
| 2017/0209923 | A1 | 7/2017 | Giovannetti et al. | |
| 2017/0225394 | A9 | 8/2017 | Rodgers et al. | |
| 2017/0259497 | A1 | 9/2017 | Prestayko et al. | |
| 2017/0297098 | A1 | 10/2017 | Myerberg et al. | |
| 2017/0297099 | A1 | 10/2017 | Gibson et al. | |
| 2017/0355138 | A1 | 12/2017 | Mark | |
| 2018/0106154 | A1 | 4/2018 | Baldwin et al. | |
| 2018/0243830 | A1 | 8/2018 | Kottilingam et al. | |
| 2018/0297272 | A1 | 10/2018 | Preston et al. | |
| 2018/0305266 | A1 | 10/2018 | Gibson | |
| 2018/0326525 | A1 | 11/2018 | Ann et al. | |
| 2018/0326660 | A1 | 11/2018 | Gifford et al. | |
| 2018/0370213 | A1 | 12/2018 | Gold et al. | |
| 2019/0032503 | A1 | 1/2019 | Shi et al. | |
| 2019/0070664 | A1 | 3/2019 | Paniogue et al. | |
| 2019/0070778 | A1 | 3/2019 | Haid et al. | |
| 2019/0093499 | A1 | 3/2019 | Sippel et al. | |
| 2019/0134971 | A1 | 5/2019 | Nielson-Cole et al. | |
| 2019/0224911 | A1 | 7/2019 | Shuck et al. | |
| 2019/0224912 | A1 | 7/2019 | Shuck et al. | |
| 2019/0344495 | A1 | 11/2019 | Shuck | |
| 2019/0351485 | A1 | 11/2019 | Shuck | |
| 2019/0389090 | A1 | 12/2019 | Roy-Mayhew et al. | |
| 2020/0076044 | A1 | 3/2020 | Alvarez et al. | |
| 2020/0277871 | A1 | 3/2020 | Shi et al. | |
| 2020/0114420 | A1 | 4/2020 | Pu et al. | |
| 2020/0316684 | A1 | 10/2020 | Shuck | |
| 2020/0391292 | A1 | 12/2020 | Shuck et al. | |
| 2020/0400033 | A1 * | 12/2020 | Jouy | F16J 15/445 |
| 2021/0060866 | A1 | 3/2021 | Nation et al. | |
| 2021/0148239 | A1 | 5/2021 | Shuck et al. | |

FOREIGN PATENT DOCUMENTS

| | | | |
|---|---|---|---|
| EP | 1108857 | A2 | 6/2001 |
| EP | 1905860 | A2 | 4/2008 |
| EP | 2354276 | A1 | 8/2011 |
| EP | 3218160 | A1 | 9/2017 |
| EP | 3276038 | A1 | 1/2018 |
| WO | 2015/077536 | A1 | 5/2015 |
| WO | 2015/130519 | A1 | 9/2015 |
| WO | 2016/012486 | A1 | 1/2016 |
| WO | 2016/077473 | A1 | 5/2016 |
| WO | 2016/108154 | A1 | 7/2016 |
| WO | 2016/125138 | A2 | 8/2016 |
| WO | 2016/125138 | A3 | 8/2016 |
| WO | 2017/081160 | A1 | 5/2017 |
| WO | 2017/180958 | A2 | 10/2017 |
| WO | 2019/110936 | A1 | 6/2019 |

OTHER PUBLICATIONS

Amendment in Response to Office Action dated Jun. 25, 2020, from U.S. Appl. No. 16/144,235, filed Sep. 25, 2020, 8 pp.

Final Office Action from U.S. Appl. No. 16/144,235, dated Oct. 5, 2020, 11 pp.

Advisory Action from U.S. Appl. No. 16/144,235, dated Jan. 6, 2021, 3 pp.

Response to Office Action dated Oct. 5, 2020, from U.S. Appl. No. 16/144,235, filed Dec. 4, 2020, 9 pp.

Office Action from U.S. Appl. No. 16/144,235, dated Jun. 25, 2020, 10 pp..

"3D Printing and Electroplating for Experimentation," Form Labs, accessed from https://formlabs.com/blog/combining-3D-printing-and-electroplating-for-replicable-experimentation/, Aug. 2, 2017, 4 pp.

"Abradable Coatings Increase Gas Turbine Engine Efficiency," AZO Materials, accessed from https://www.azom.com/article.aspx?ArticleID=739, Aug. 23, 2001, 7 pp.

"Amazing Six-Axis 3D Printer Shown," /blog/2013/10/10/AMAZING-SIX-AXIS-3D-PRINTER-SHOWN-HTML, Fabbaloo, Oct. 10, 2013, 5 pp.

"FDM Best Practice: Embedding Hardware," Stratasys, 2014 (Applicant points out, in accordance with MPEP 609.04 (a), that the year of publication, 2014, is sufficiently earlier than the effective U.S. filing date, so that the particular month of publication is not in issue.) 6 pp.

"Lightweight, Composite Metal Foam Stops Bullet," [Abstract only] Materials, Tech Briefs Media Group, retrieved from https://www.techbriefs.com/component/content/article/tb/tv/34642 on Nov. 4, 2019, 1 pp.

"Metal Plating For Your 3D Printed Parts—A Practical Guide," AMFG, accessed from https://amrg.ai/2017/07/06/metal-plating-3d-printed-parts/, Jul. 6, 2017, 3 pp.

Allen et al., "An Experimental Demonstration of Effective Curved Layer Fused Filament Fabrication Utilising a Parallel Deposition Robot," Additive Manufacturing, vol. 8, Oct. 2015, pp. 78-87.

Crease, "MMF #4: Embedding Nuts in 3D Printed Parts for Hidden Fastener Strength," markforged.com/blog, Jul. 27, 2016, 18 pp.

Frick, "Additive Manufacturing Comes to Metal Foam," Materials, Machine Design, accessed from https://www.machinedesign.com/materials/article/21830512/additive-manufacturing-comes-to-metal-foam, Apr. 26, 2013, 13 pp.

(56) References Cited

OTHER PUBLICATIONS

Hobson, "Electroplating Copper and Silver Onto 3D Prints," Hackaday, accessed from https://hackaday.com/2015/01/12/electroplating-copper-and-silver-onto-3d-prints/, Jan. 12, 2015, 2 pp.
Jakus, "Metallic Architectures from 3D-Printed Powder-Based Liquid Inks," Wiley Library, Advanced Functional Materials, Nov. 2015, 11 pp.
Kieizman et al., "Layered Manufacturing Material Issues for SDM of Polymers and Ceramics," International Solid Freeform Fabrication Symposium, Jan. 1997, 9 pp.
Ota et al., "Application of 3D Printing for Smart Objects with Embedded Electronic Sensors and Systems," Advanced Materials Technologies, Mar. 2, 2016, 22 pp.
Ross et al., "Compressor Seal Selection and Justification," Proceedings of the Thirty-Second Turbomachinery Symposium, 2003 (Applicant points out, in accordance with MPEP 609.04(a), that the year of publication, 2003, is sufficiently earlier than the effective U.S filing date, so that the particular month of publication is not in issue.) pp. 167-178.
Shafer et al., "Cleated Print Surface for Fused Deposition Modeling," Solid Freeform Fabrication 2016: Proceedings of the 26th Annual International Solid Freeform Fabrication Symposium, Jan. 2017, pp. 1359-1365.
Shim et al., "Additive Manufacturing of Porous Metals Using Laser Melting of Ti6AI4V Powder With a Foaming Agent," IOP Publishing, Materials Research Express, vol. 5, Jul. 25, 2018, 10 pp.
U.S. Appl. No. 17/096,112, filed Nov. 12, 2020, by Shuck et al.
Walter, "3D Printering: Non-Planar Layer FDM," Hackaday, Jul. 27, 2016, 12 pp.
Wolff, "Conductive Thermoplastics for 3D Printing," SME Media, accessed from https://advancedmanufacturing.org/3d-printed-thermoplastics/, Feb. 9, 2017, 9 pp.
Yuen, "Embedding Objects During 3D Printing to Add to New Functionalities," Biomicrofluidics, vol. 10, Issue 4, Jul. 13, 2016, 10 pp.

* cited by examiner

NON-CONTINUOUS ABRADABLE COATINGS

This application claims the benefit of U.S. Provisional Patent Application No. 62/697,076 filed Jul. 12, 2018, which is incorporated herein by reference in its entirety.

TECHNICAL FIELD

The present disclosure relates to generally relates to abradable coatings, and in particular, to non-continuous abradable coatings.

BACKGROUND

Components of high-performance systems, such as, for example, turbine or compressor components, operate in severe environments. For example, turbine blades, vanes, blade tracks, and blade shrouds exposed to hot gases in commercial aeronautical engines may experience metal surface temperatures of about 1000° C.

High-performance systems may include rotating components, such as blades, rotating adjacent a surrounding structure, for example, a shroud. Reducing the clearance between rotating components and a shroud may improve the power and the efficiency of the high-performance component. The clearance between the rotating component and the shroud may be reduced by coating the blade shroud with an abradable coating. Turbine engines may thus include abradable coatings at a sealing surface or shroud adjacent to rotating parts, for example, blade tips. A rotating part, for example, a turbine blade, can abrade a portion of a fixed abradable coating applied on an adjacent stationary part as the turbine blade rotates. Over many rotations, this may wear a groove in the abradable coating corresponding to the path of the turbine blade. The abradable coating may thus form an abradable seal that can reduce the clearance between rotating components and an inner wall of an opposed shroud, which can reduce leakage around a tip of the rotating part or guide leakage flow of a working fluid, such as steam or air, across the rotating component, and enhance power and efficiency of the high-performance component.

SUMMARY

The disclosure describes components, systems, and techniques relating to non-continuous abradable coatings. In some examples, the abradable coating may include three or more portions, each portion including a plurality of coating blocks. For example, a first portion may include a first plurality of coating blocks, a second portion may include a second plurality of coating blocks, and a blade rub portion extending between the first and second portions may include a third plurality of coating blocks. At least one of the first or second plurality of coating blocks may be different than the third plurality of coating blocks in at least one coating block parameter, which may improve blade rub, reduce stress, increase erosion resistance, reduce leakage, require less coating material, or the like in comparison to some other coatings.

In one example, a component includes a substrate and a non-continuous abradable coating on the substrate. The abradable coating includes a first portion defining a first plurality of coating blocks, a second portion defining a second plurality of coating blocks, and a blade rub portion extending between the first portion and the second portion and defining a third plurality of coating blocks, where at least one of the first plurality of coating blocks or the second plurality of coating blocks is different than the third plurality of coating blocks in at least one coating block parameter.

In another example, a system includes a component including a substrate and a non-continuous abradable coating on the substrate and a rotating component configured to contact an abradable surface defined by the non-continuous abradable coating with a portion of the rotating component. The abradable coating includes a first portion defining a first plurality of coating blocks, a second portion defining a second plurality of coating blocks, and a blade rub portion extending between the first portion and the second portion and defining a third plurality of coating blocks, where at least one of the first plurality of coating blocks or the second plurality of coating blocks is different than the third plurality of coating blocks in at least one coating block parameter.

In yet another example, a method includes positioning one or more templates on a surface of a substrate and thermal spraying an abradable coating composition through the one or more templates to cause the abradable coating composition to deposit on the substrate as a non-continuous abradable coating. The one or more templates define a first portion defining a first plurality of coating block cells, a second portion defining a second plurality of coating block cells, and a blade rub portion extending between the first portion and the second portion and defining a third plurality of coating block cells. The abradable coating deposited on the substrate includes a first portion defining a first plurality of coating blocks, a second portion defining a second plurality of coating blocks, and a blade rub portion extending between the first portion and the second portion and defining a third plurality of coating blocks, where at least one of the first plurality of coating blocks or the second plurality of coating blocks is different than the third plurality of coating blocks in at least one coating block parameter.

The details of one or more examples of the disclosure are set forth in the accompanying drawings and the description below. Other features, objects, and advantages of the disclosure will be apparent from the description and drawings, and from the claims.

DETAILED DESCRIPTION

Figure 1:
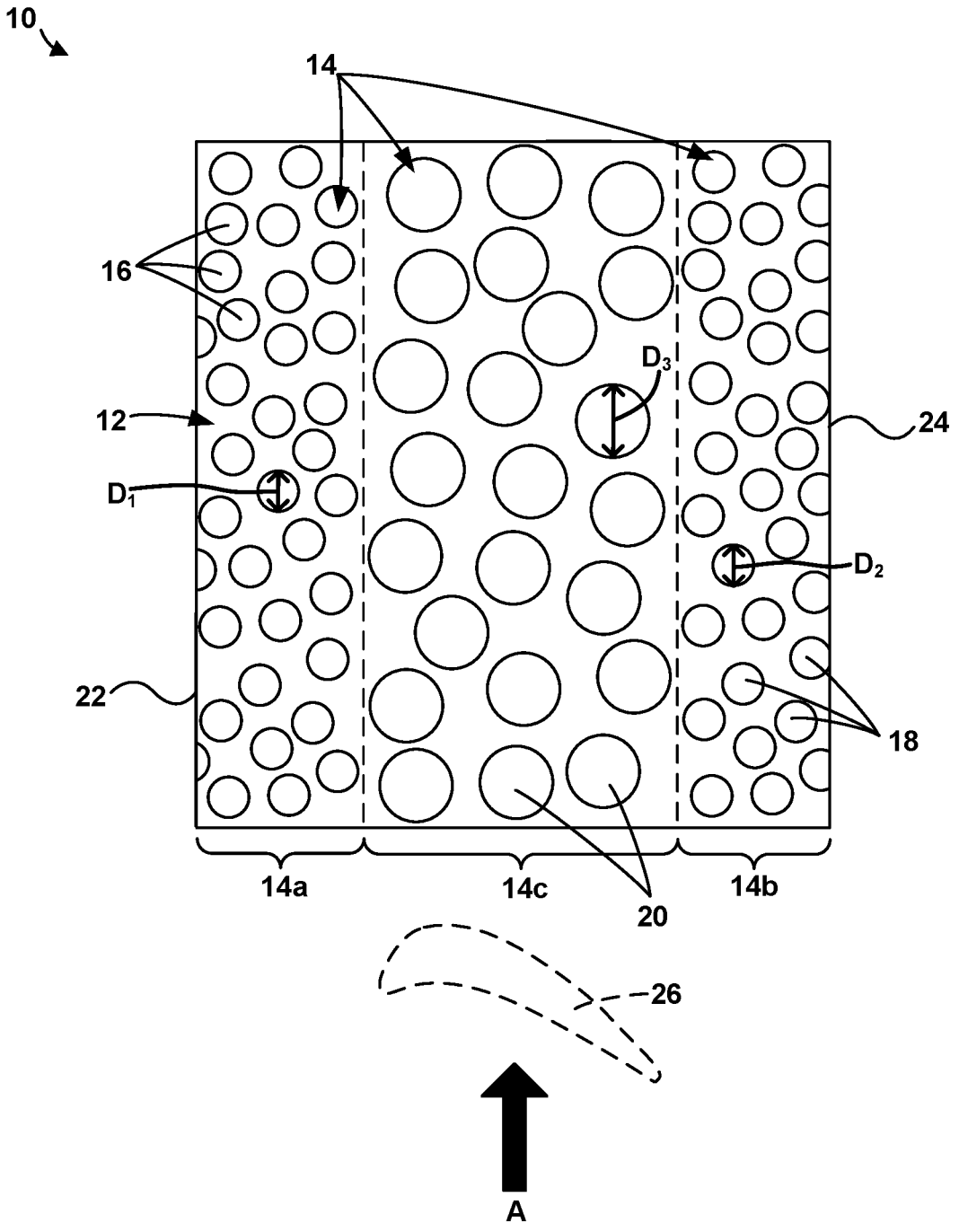
FIG. 1 is a conceptual diagram illustrating a top view of an example component including a non-continuous abradable coating that includes a first plurality of coating blocks and second plurality of coating blocks that differ from a third plurality of coating blocks in average block size.

The disclosure describes components, systems, and techniques relating to non-continuous abradable coatings. In some examples, the abradable coating may include at least three portions or regions, each portion or region including a plurality of coating blocks. For example, a first portion may include a first plurality of coating blocks, a second portion may include a second plurality of coating blocks, and a blade rub portion extending between the first and second portions may include a third plurality of coating blocks. At least one of the first or second plurality of coating blocks may be different than the third plurality of coating blocks in at least one coating block parameter. In some examples, the at least one coating block parameter may include one or more of average coating block size, average pitch between coating blocks, coating block shape, or coating block orientation. Such differences in the pluralities of coating blocks of the various portions of the non-continuous abradable coatings described herein may improve blade rub, reduce stress, increase erosion resistance, reduce leakage, require less coating material, or the like, in comparison to some other coatings not including at least one of a first or a second plurality of coating blocks different than a third plurality of coating blocks in at least one coating block parameter.

Some components of high temperature mechanical systems, such as components of gas turbine engines, may include continuous abradable coatings. In some such examples, the continuous abradable coatings may be subject to increased residual stress, as well as stress from thermal and/or mechanical conditions of the high temperature mechanical system. Continuous abradable coatings subject to increased stress may have reduced bond strength of the abradable coating to an underlying component or layer, may be more likely to spall or crack, may be less tolerant of thermal cycling of the component, or the like. In turn, the useful life of the coating may be reduced, which may result in premature replacement of the coating, reduced protection of the underlying component or layer, increased leakage, or the like. Moreover, continuous abradable coatings may require more coating material than non-continuous abradable coatings, may be more difficult to be abraded by a rotating component configured to contact the abradable coating, or the like.

Some components of high temperature mechanical systems, such as components of gas turbine engines, may include relatively uniform non-continuous abradable coatings. A relatively uniform non-continuous abradable coating may be less abradable or provide reduced protection to the underlying component than the non-continuous abradable coatings described herein. For example, a relatively uniform non-continuous abradable coating configured to be easily abraded by a rotating component may have reduced erosion resistance, increased leakage, or the like, whereas a relatively uniform non-continuous abradable coating configured to provide increased erosion resistance and/or reduced leakage may be more difficult to be abraded by the rotating component. In other words, some non-continuous abradable coatings that are relatively uniform may exhibit some desired properties at the expense of some other properties.

In some examples, the non-continuous abradable coating described herein including at least one of a first plurality of coating blocks or a second plurality of coating blocks different than a third plurality of coating blocks in at least one coating block parameter may be more easily abraded by a rotating component configured to contact the non-continuous abradable coating, while still providing protection to an underlying component, in comparison to some other non-continuous abradable coatings. For example, the plurality of coating blocks of a blade rub portion of the non-continuous abradable coating different in at least one of average coating block size, average pitch between coating blocks, coating block shape, or coating block orientation from the first plurality of coating blocks, the second plurality of coating blocks, or both, may configure the blade rub portion to be more easily abraded in comparison to coatings in which a plurality of coating blocks of the blade rub portion are the same or substantially the same as a plurality of coating blocks of first or second portions flanked on either side of the blade rub portion (e.g., an abradable coating in which all of the plurality of coating blocks are all the same or substantially the same).

FIG. 1 is a conceptual diagram illustrating a top view of an example component 10 including a non-continuous abradable coating 14 that includes a first plurality of coating blocks 16 and second plurality of coating blocks 18 that differ from a third plurality of coating blocks 20, for example, in average block size. Component 10 may include a mechanical component operating at relatively high conditions of temperature, pressure, or stress, for example, a component of a turbine, a compressor, or a pump. In some examples, component 10 includes a gas turbine engine component, for example, an aeronautical, marine, or land-based gas turbine engine. Component 10 may include, for example, a blade track or blade shroud (or segment of a blade track or blade shroud) that circumferentially surrounds a rotating component, for example, a rotating blade 26.

In the example of FIG. 1, non-continuous abradable coating 14 is on or adjacent a substrate 12. Substrate 12 may include a material suitable for use in a high-temperature environment. In some examples, substrate 12 includes a superalloy including, for example, an alloy based on Ni, Co, Ni/Fe, or the like. In examples in which substrate 12 includes a superalloy material, substrate 12 may also include one or more additives for improving the mechanical properties of substrate 12 including, for example, toughness, hardness, temperature stability, corrosion resistance, oxidation resistance, or the like. For example, the one or more additives may include titanium (Ti), cobalt (Co), or aluminum (Al).

In some examples, substrate 12 may include a ceramic or a ceramic matrix composite (CMC). Suitable ceramic materials may include, for example, a silicon-containing ceramic, such as silica ($SiO_2$) and/or silicon carbide (SiC); silicon nitride ($Si_3N_4$); alumina ($Al_2O_3$); an aluminosilicate; a transition metal carbide (e.g., WC, $Mo_2C$, TiC); a silicide (e.g., $MoSi_2$, $NbSi_2$, $TiSi_2$); combinations thereof; or the like. In some examples in which substrate 12 includes a ceramic, the ceramic may be substantially homogeneous. In examples in which substrate 12 includes a CMC, substrate 12 may include a matrix material and a reinforcement material. The matrix material and reinforcement materials may include, for example, any of the ceramics described herein. The reinforcement material may be continuous or discontinuous. For example, the reinforcement material may include discontinuous whiskers, platelets, fibers, or particulates. Additionally, or alternatively, the reinforcement material may include a continuous monofilament or multifilament two-dimensional or three-dimensional weave, braid, fabric, or the like. In some examples, the CMC includes an SiC matrix material (alone or with residual Si metal) and an SiC reinforcement material.

Substrate 12 may define a leading edge 22 and a trailing edge 24. In some examples, leading edge 22 and trailing edge 24 may be substantially parallel to each other. In other examples, leading edge 22 and trailing edge 24 may not be substantially parallel to each other. In some cases, a first axis extending between leading edge 22 and trailing edge 24 may be in a substantially axial direction of a gas turbine engine including component 10 (e.g., parallel to the axis extending from the intake to the exhaust of the gas turbine engine). Thus, in some such cases, leading edge 22 and trailing edge 24 may be perpendicular or substantially perpendicular to the axial direction of the gas turbine engine including component 10.

Component 10 includes non-continuous abradable coating 14 on substrate 12. Non-continuous abradable coating 14 may extend from leading edge 32 to trailing edge 34 of substrate 12. In some examples, non-continuous abradable coating 14 may include a first portion 14*a*, a second portion 14*b*, and a blade rub portion 14*c*. Blade rub portion 14*c* may extend between first portion 14*a* and second portion 14*b*, and may be configured to be abraded, e.g., by blade 26 (or a tip of blade 26) of a gas turbine engine, in order to form a relatively tight seal between component 10 and blade 26. For example, blade 26 may be configured to rotate in the direction of arrow A shown in FIG. 1 and contact blade rub portion 14*c*. In some examples, arrow A may be in a substantially circumferential direction of a gas turbine engine including component 10, such that blade 26 rotates in a substantially circumferential direction. Abradability of blade rub portion 14*c* may include a disposition to break into relatively small pieces, granules, or powder, when exposed to a sufficient physical force (e.g., by blade 26). Abradability may be influenced by the material characteristics of the material forming blade rub portion 14*c* of non-continuous abradable coating 14, such as fracture toughness and fracture mechanism (e.g., brittle fracture), one or more coating block parameters of blade rub portion 14*c*, and/or the porosity of the coating blocks of blade rub portion 14*c*.

Figure 4:
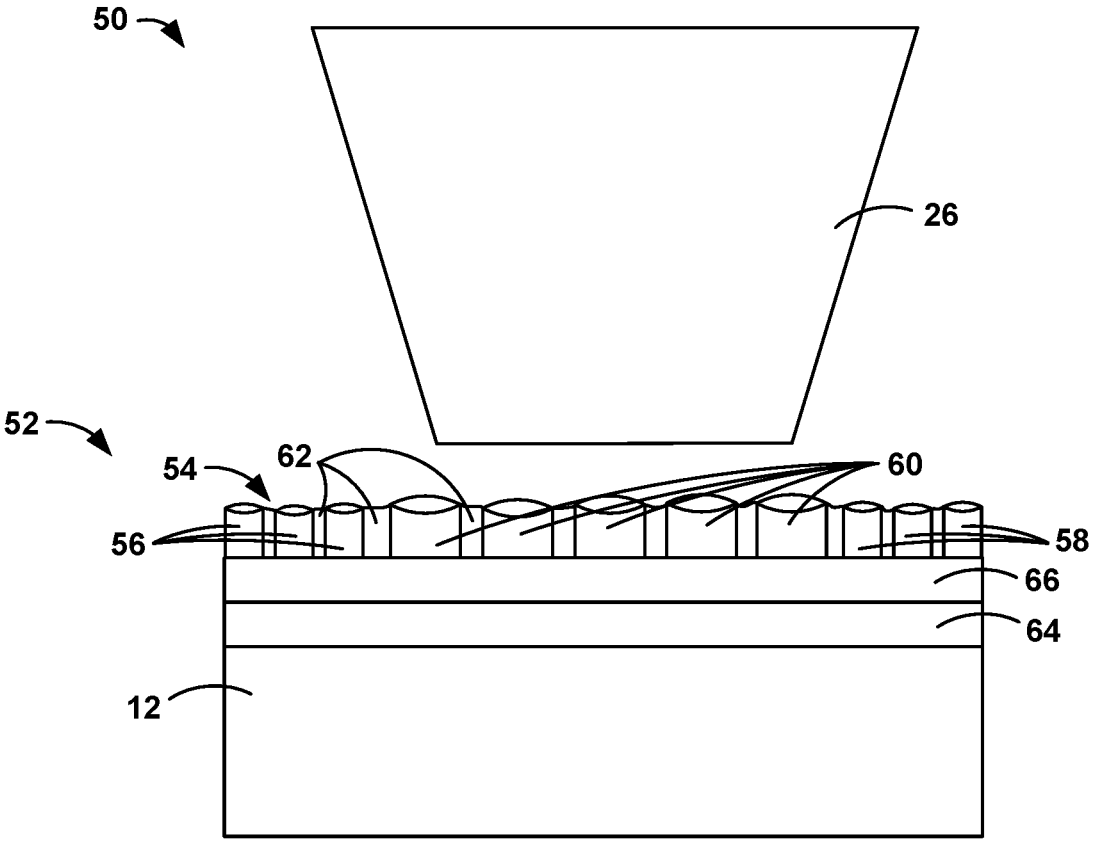
FIG. 4 is a conceptual diagram illustrating a side view of an example system including a blade and a component that includes a substrate and a non-continuous abradable coating on the substrate.

As seen in FIG. 1, each of first portion 14*a*, second portion 14*b*, and blade rub portion 14*c* of non-continuous abradable coating 14 includes a plurality of coating blocks 16, 18, or 20, respectively. For example, first portion 14*a* includes a first plurality of coating blocks 16, second portion 14*b* includes a second plurality of coating blocks 18, and blade rub portion 14*c* includes a third plurality of coating blocks 20. In some examples, each respective coating block of the first, second, and third plurality of coating blocks 16, 18, 20 may be spaced from a respective adjacent coating block of the first, second, and third coating block 16, 18, 20. In some such examples, a spacing between each respective coating block of the first, second, and third plurality of coating blocks 16, 18, 20 and a respective adjacent coating block of the first, second, and third plurality of coating blocks 16, 18, 20 may extend through an entire thickness of first portion 14*a*, second portion 14*b*, or blade rub portion 14*c*, respectively, of non-continuous abradable coating 14. In other examples, the spacings may extend through a majority (e.g., more than 50%) of the thickness of the respective portion 14*a* to 14*c* of non-continuous abradable coating 14. For example, the spacings may extend through at least about 75% or at least about 90% of the thickness respective portion 14*a*-14*c* of non-continuous abradable coating 14. In any case, non-continuous abradable coating 14 including spacings between adjacent coating blocks of the first, second, and/or third pluralities of coating blocks 16, 18, 20 may reduce stress in non-continuous abradable coating 14. For example, such spacings may reduce tensile stress due to thermal expansion of substrate 12. Another example illustrating spacings between adjacent coating blocks is shown in the example of FIG. 4.

In the example of FIG. 1, the first, second, and third pluralities of coating blocks 16, 18, and 20 all include respective coating blocks that have circular contour shapes. In other examples, one or more of the first plurality of coating blocks 16, the second plurality of coating blocks 18, or the third plurality of coating blocks 20 may have a contour shape other than a circle. For instance, one or more of the first plurality of coating blocks 16, the second plurality of coating blocks 18, or the third plurality of coating blocks 20 may have a contour shape of a triangle, a square, a rectangle, a hexagon, a closed polygon, an ellipse, a closed curvilinear shape, or another regular or irregular shape. Moreover, one or more of the first plurality of coating blocks 16, the second plurality of coating blocks 18, or the third plurality of coating blocks 20 may have a more than one contour shape. For example, one or more of the first, second, or third plurality of coating blocks 16, 18, 20 may include coating blocks with a circular contour shape and coating blocks with a rectangular contour shape. In some cases, the contour shape of the respective plurality of coating blocks 16, 18, 20 may provide first, second, or blade rub portions 14*a* to 14*c* of non-continuous abradable coating 14 with certain properties. For example, a shape of the respective coating blocks of the third plurality of coating blocks 20 may contribute to the abradability of blade rub portion 14*c*. As one example, contour shapes that are rounded or do not include relatively sharp edges or corners may be more easily abraded or put less stress on blade 26 upon contact with the respective coating blocks in comparison to contour shapes with relatively sharp edges or corners. Thus, in some examples, such as the example of FIG. 3, the third plurality of coating blocks 20 of blade rub portion 14*c* may be different in contour shape than at least one of the first or second plurality of coating blocks 16, 18.

At least one of the first plurality of coating blocks 16 or the second plurality of coating blocks 18 may be different from the third plurality of coating blocks 20 in at least one coating block parameter. In turn, at least one of first portion 14*a* or second portion 14*b* may have different properties than those of blade rub portion 14*c*. For example, the third plurality of coating blocks 20 of blade rub portion 14*c* may be configured to be more easily abraded than the first or second plurality of coating blocks 16, 18, and the first and/or second plurality of coating blocks 16, 18 of first and second portions 14*a*, 14*b*, respectively, may be configured to provide increased protection to the portions of non-continuous abradable coating 14 not configured to be contacted by blade 26. Thus, non-continuous abradable coating 14 including various portions 14*a* to 14*c* with pluralities of coating blocks 16, 18, and 20 that differ in at least one coating block parameter may enable non-continuous abradable coating 14 to be tailored to provide certain properties based on the portion of substrate 12 in which portions 14*a* to 14*c* of non-continuous abradable coating 14 are on. In other words, non-continuous abradable coating 14 that includes the third plurality of coating blocks 20 having at least one coating block parameter different from the first and/or second pluralities of coating blocks 16, 18 may improve blade rub, while also reducing stress, increasing erosion resistance, reducing leakage, or the like in comparison to some other coatings.

In some examples, the first plurality of coating blocks 16, the second plurality of coating blocks 18, or both, may be different than the third plurality of coating blocks 20 in at least one coating block parameter. In some such examples, the at least one coating block parameter may include an average coating block size, an average pitch between coating blocks, a coating block shape, or a coating block orientation. The average coating block size may be a population average of the largest diameters, or dimensions of major axis passing through geometric centers, of blocks of a respective portion. For example, in the case of circular blocks, the average coating block size may be determined in terms of population average of diameters of respective circular blocks. In the example of FIG. 1, both the first plurality of coating blocks 16 and the second plurality of coating blocks 18 differ from the third plurality of coating blocks 20 in average coating block size. For example, the first plurality of coating blocks 16 may define a first average coating block size $D_1$ (e.g., a population average of coating block diameters in portion 14*a* in the case of the circular coating blocks of FIG. 1), the second plurality of coating blocks 18 may define a second average coating block size $D_2$, and the third plurality of coating blocks 20 may define a third average coating block size $D_3$. In some examples, first average coating block size $D_1$ and/or second average coating block size $D_2$ may be different than third average coating block size $D_3$.

In the example of FIG. 1, both first average coating block size $D_1$ and second average coating block size $D_2$ are less than third average coating block size $D_3$. In other examples, only one of first average coating block size $D_1$ or second average coating block size $D_2$ may be less than third average coating block size $D_3$, or one of first or second average coating block size $D_1$, $D_2$ may be greater than third average coating block size $D_3$. In some examples, the relatively large third average coating block size $D_3$ may result in blade rub portion 14*c* of non-continuous abradable coating 14 being less dense than first and/or second portions 14*a*, 14*b*, which may facilitate blade 26 abrading non-continuous abradable coating 14 in blade rub portion 14*c*. In a similar manner, the relatively small first and second average coating block sizes $D_1$, $D_2$ may result in first and second portions 14*a*, 14*b* of non-continuous abradable coating 14 being denser than blade rub portion 14*c*. In turn, first portion 14*a* and/or second portion 14*b* may reduce leakage, provide increased protection to substrate 12, increase erosion resistance, or the like. In this way, non-continuous abradable coating 14 with at least one of the first or second pluralities of coating blocks 16, 18 different than the third plurality of coating blocks 20 may provide specific properties to first and second portions 14*a*, 14*b* (e.g., reduced leakage, increased protection, increased erosion resistance, or the like) of non-continuous abradable coating 14, as well as to blade rub portion 14*c* (e.g., improved abradability).

Non-continuous abradable coating 14 may include any suitable material. For example, non-continuous abradable coating 14 may be formed from materials that exhibit a hardness that is relatively lower than a hardness of blade 26 such that a blade tip of blade 26 can abrade blade rub portion 14*c* of non-continuous abradable coating 14 by contact. Thus, the hardness of non-continuous abradable coating 14, or at least blade rub portion 14*c* of non-continuous abradable coating 14, relative to the hardness of the blade tip may be indicative of the abradability of blade rub portion 14*c*. The composition of non-continuous abradable coating 14 will be described generally with respect to non-continuous abradable coating 14 (e.g., including first, second, and blade rub portions 14*a* to 14*c*). Thus, in some examples, first portion 14*a*, second portion 14*b*, and/or blade rub portion 14*c* may include the same or substantially the same composition. It should be understood that in other examples, however, at least one of first portion 14*a*, second portion 14*b*, or blade rub portion 14*c* may include a composition different than at least one other of first portion 14*a*, second portion 14*b*, or third portion 14*c*. For example, the abradability of non-continuous abradable coating 14 may depend on the respective composition (e.g., the physical and mechanical properties of the composition) of the coating, and therefore, in some cases, blade rub portion 14*c* may include a different composition than that of one or both of first portion 14*a* or second portion 14*b*.

In some examples, non-continuous abradable coating 14 may include a matrix composition. Such a matrix composition of non-continuous abradable coating 14 may include at least one of aluminum nitride, aluminum diboride, boron carbide, aluminum oxide, mullite, zirconium oxide, carbon, silicon carbide, silicon nitride, silicon metal, silicon alloy, a transition metal nitride, a transition metal boride, a rare earth oxide, a rare earth silicate, a stabilized zirconium oxide (for example, yttria-stabilized zirconia), a stabilized hafnium oxide (for example, yttria-stabilized hafnia), barium-strontium-aluminum silicate, or combinations thereof. In some examples, non-continuous abradable coating 14 includes at least one silicate, which may refer to a synthetic or naturally-occurring compound including silicon and oxygen. Suitable silicates include, but are not limited to, rare earth disilicates, rare earth monosilicates, barium strontium aluminum silicate, or combinations thereof.

In some cases, non-continuous abradable coating 14 may include a base oxide of zirconia or hafnia and at least one rare earth oxide, such as, for example, oxides of Lu, Yb, Tm, Er, Ho, Dy, Gd, Tb, Eu, Sm, Pm, Nd, Pr, Ce, La, Y, and Sc. For example, non-continuous abradable coating 14 may include predominately (e.g., the main component or a majority) the base oxide zirconia or hafnia mixed with a minority amounts of the at least one rare earth oxide. In some examples, non-continuous abradable coating 14 may include the base oxide and a first rare earth oxide including ytterbia, a second rare earth oxide including samaria, and a third rare earth oxide including at least one of lutetia, scandia, ceria, neodymia, europia, or gadolinia. In some examples, the third rare earth oxide may include gadolinia such that non-continuous abradable coating 14 may include zirconia, ytterbia, samaria, and gadolinia.

Non-continuous abradable coating 14 may optionally include other elements or compounds to modify a desired characteristic of the coating layer, such as, for example, phase stability, thermal conductivity, or the like. Example additive elements or compounds include, for example, rare earth oxides. The inclusion of one or more rare earth oxides, such as ytterbia, gadolinia, and samaria, within a layer of predominately zirconia may help decrease the thermal conductivity of non-continuous abradable coating 14, e.g., compared to a composition including zirconia and yttria.

In some examples, in addition to the coating block parameters and/or the composition of non-continuous abradable coating layer 14, the abradability of the non-continuous abradable coating 14 may also depend on a porosity of the coating blocks of the respective first, second, or third pluralities of coating blocks 16, 18, or 20. For example, a relatively porous composition of coating blocks 16, 18, 20 may exhibit a higher abradability compared to a relatively nonporous composition, and a composition with a relatively higher porosity may exhibit a higher abradability compared to a composition with a relatively lower porosity, everything else remaining the same. Moreover, relatively porous coating blocks of the plurality of coating blocks 16, 18, or 20 may have a decreased thermal conductivity in comparison to coating blocks with relatively lower porosities or dense microstructures.

Thus, in some examples, each coating block of the first, second, and/or third plurality of coating blocks 16, 18, 20 may include a plurality of pores. The plurality of pores may include at least one of interconnected voids, unconnected voids, partly connected voids, spheroidal voids, ellipsoidal voids, irregular voids, or voids having any predetermined geometry, or networks thereof. In some examples, each coating block of the first and second plurality of coating blocks 16, 18 may exhibit a lower porosity than each coating block of the third plurality of coating blocks 20. For example, each coating block of the first and second plurality of coating blocks 16, 18 may exhibit a porosity of less than about 10 vol. %, and each coating block of the third plurality of coating blocks 20 may exhibit a porosity between about 50 vol. % and about 80 vol. %, where porosity is measured as a percentage of pore volume divided by total volume of the respective coating block of the first, second, and/or third plurality of coating blocks 16, 18, 20. The porosity of the respective coating blocks may be measured using mercury porosimetry, optical microscopy, a method based on Archimedes' principle, e.g., a fluid saturation technique, or the like.

In some examples, at least one of the coating blocks of the first, second, and/or third plurality of coating blocks 16, 18, 20 may each have a porosity different than another of the coating blocks of the first, second, and/or third plurality of coating blocks 16, 18, 20. For instance, in some cases, each coating block of the third plurality of coating blocks 20 may have a higher porosity than one or both of the respective coating blocks of the first plurality of coating blocks 16 or the second plurality of coating blocks 18, which may enable blade rub portion 14*c* to be more easily abraded than first or second portion 14*a*, 14*b*. Moreover, the coating blocks of the first and/or second plurality of coating blocks 16, 18 with a relatively lower porosity than the coating blocks of the third plurality of coating blocks 20 may help prevent leakage, provide increased protection to substrate 12, increase erosion resistance, or combinations thereof.

In some examples, the porosity of the coating blocks may be created and/or controlled by plasma spraying the coating material using a co-spray process technique in which the coating material and a coating material additive are fed into a plasma stream with two or more radial powder feed injection ports. For example, a coating material additive that melts or burns at the use temperatures of component 10 may be incorporated into the coating material that forms the coating blocks of non-continuous abradable coating 14. The coating material additive may include, for example, graphite, hexagonal boron nitride, or a polymer such as a polyester, and may be incorporated into the coating material prior to deposition of the coating material on substrate 12 to form the coating blocks of non-continuous abradable coating 14. The coating material additive then may be melted or burned off in a post-formation heat treatment, or during operation of component 10 (e.g., operation of gas turbine engine 10), to form pores in the coating blocks. The post-deposition heat-treatment may be performed at up to about 1150° C. for a component having a substrate 12 that includes a superalloy, or at up to about 1500° C. for a component having a substrate 12 that includes a CMC or other ceramic.

In other examples, the porosity of the coating blocks of non-continuous abradable coating 14 may be created or controlled in a different manner, and/or the coating blocks of the plurality of coating blocks 16, 18, 20 may be deposited on substrate 12 using a different technique. For example, non-continuous abradable coating 14 may be deposited using a wide variety of coating techniques, including, for example, thermal spraying, e.g., air plasma spraying, HVOF spraying, low vapor plasma spraying, suspension plasma spraying; PVD, e.g., EB-PVD, DVD, or cathodic arc deposition; CVD; slurry process deposition; sol-gel process deposition; electrophoretic deposition; or the like.

As described above, non-continuous abradable coating 14 may extend between leading edge 22 and trailing edge 24 of substrate 12. For example, first portion 14*a* may extend from leading edge 22 to a center portion of substrate 12, second portion 14*b* may extend from trailing edge 24 to the center portion of substrate 12, and blade rub portion 14*c* may extend between first portion 14*a* and second portion 14*b*. In some examples, blade rub portion 14*c* may be wider than a width of blade 26 or a tip of blade 26. For instance, blade rub portion 14*c* may define a width measured along an axial axis extending from leading edge 22 to trailing edge 24 of substrate 12 that is greater than a width of blade 26 or a tip of blade 26 (and any potential axial travel of blade 26) measured along the axial axis. In this way, blade 26 may be able to form a blade path in blade rub portion 14*c* without contacting and/or abrading an underlying coating layer or substrate 12. In other examples, the width of blade rub portion 14*c* may be less than or equal to the width of blade 26 or a tip of blade 26 (and any potential axial travel of blade 26).

In some examples, non-continuous abradable coating 14 (or at least blade rub portion 14*c* of non-continuous abradable coating 14) may be thick enough such that the blade tip of blade 26 can abrade non-continuous abradable coating 14 to form a blade path in blade rub portion 14*c* without contacting and/or abrading an underlying coating layer or substrate 12. In some such examples, non-continuous abradable coating 14 may have a thickness of between about 0.025 mm (about 0.01 inches) and about 3 mm (about 0.12 inches). In other examples, non-continuous abradable coating 14 may have other thicknesses.

In some examples, in addition to, or as an alternative to, the third plurality of coating blocks 20 of blade rub portion 14*c* being different from at least one of the first plurality of coating blocks 16 or the second plurality of coating blocks 18 in average coating block size, the third plurality of coating blocks 20 of blade rub portion 14*c* may be different from at least one of the first plurality of coating blocks 16 or the second plurality of coating blocks 18 in a different coating block parameter. For example, the third plurality of coating blocks 20 of blade rub portion 14*c* may be different from at least one of the first plurality of coating blocks 16 or the second plurality of coating blocks 18 in an average pitch between coating blocks.

Figure 2:
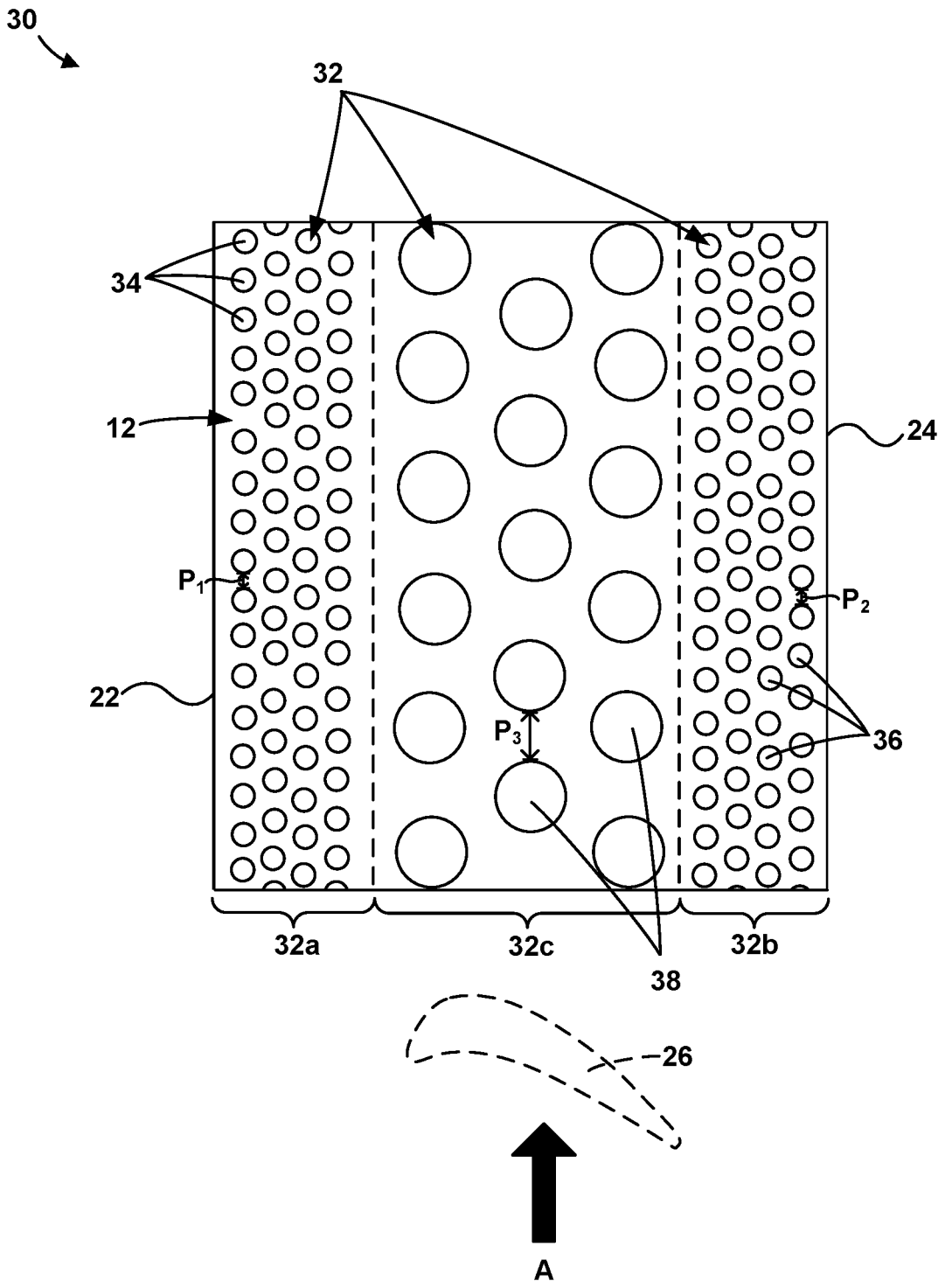
FIG. 2 is a conceptual diagram illustrating a top view of an example component including a non-continuous abradable coating that includes a first plurality of coating blocks and second plurality of coating blocks that differ from a third plurality of coating blocks in average inter-block pitch.

FIG. 2 is a conceptual diagram illustrating a top view of an example component 30 including a non-continuous abradable coating 32 that includes a first plurality of coating blocks 34 and second plurality of coating blocks 36 that differ from a third plurality of coating blocks 38, for example, in inter-block pitch. Non-continuous abradable coating 32 may be substantially similar to non-continuous abradable coating 14 of FIG. 1 in composition and one or more block parameters. For instance, non-continuous abradable coating 32 may be the same or substantially the same as non-continuous abradable coating 14, except for the respective coating block parameter in which the coating blocks of a first portion 32*a* and/or a second portion 32*b* of non-continuous abradable coating 32 differs from the coating blocks of a blade rub portion 32*c*. For example, in the example of FIG. 1, the first and second pluralities of coating blocks 16, 18 of first and second portions 14*a*, 14*b* differ from the third plurality of coating blocks 20 of blade rub portion 14*c* in average coating block size. In the example of FIG. 2, a first plurality of coating blocks 34 of first portion 32*a* and a second plurality of coating blocks 36 of second portion 32*b* differ from a third plurality of coating blocks 38 of blade rub portion 32*c* in average pitch between coating blocks. In some examples, coating blocks 34 of first portion 32*a* or coating blocks 36 of second portion may additionally differ from coating blocks 38 of blade rub portion 32 in average block size.

In some examples, both the first plurality of coating blocks 34 and the second plurality of coating blocks 36 differ from the third plurality of coating blocks 38 in average pitch between coating blocks. The average pitch between coating blocks may be an average distance between adjacent coating blocks of the respective plurality of coating blocks 34, 36, 38 (e.g., an average size of the space between the respective adjacent coating blocks). For example, the first plurality of coating blocks 34 may define a first average pitch between coating blocks $P_1$, the second plurality of coating blocks 36 may define a second average pitch between coating blocks $P_2$, and the third plurality of coating blocks 38 may define a third average pitch between coating blocks $P_3$. Although the first, second, and third average pitches $P_1$, $P_2$, $P_3$ are illustrated in FIG. 2 as measured in the circumferential direction (e.g., in the direction of arrow A), in other examples, the average pitches between coating blocks $P_1$, $P_2$, $P_3$ may be measured in any suitable direction. Moreover, in some cases, the first, second, or the plurality of coating blocks 34, 36, 38 may define more than one pitch between coating blocks. For example, first, second, and third pluralities of coating blocks 34, 36, 38 may define first, second, and third pitches $P_1$, $P_2$, $P_3$, respectively, in the circumferential direction, and may define alternative pitches between coating blocks in the axial direction.

In some examples, first average pitch between coating blocks $P_1$ and/or second average pitch between coating blocks $P_2$ may be different than third average pitch between coating blocks $P_3$. For instance, at least one of first average pitch between coating blocks $P_1$ or second average pitch between coating blocks $P_2$ may be less than third average pitch between coating blocks $P_3$. In other examples, at least one of first or second average pitch between coating blocks $P_1$, $P_2$ may be greater than third average pitch between coating blocks $P_3$. In some examples, at least one of first average pitch between coating blocks $P_1$ or second average pitch between coating blocks $P_2$ being less than third average pitch between coating blocks $P_3$ may enable the third plurality of coating blocks 38 to be more easily abraded in comparison to the first or second plurality of coating blocks 34, 36. For example, the relatively large third average pitch between coating blocks $P_3$ may result in blade rub portion 32*c* of non-continuous abradable coating 32 being less dense than first and/or second portions 32*a*, 32*b*, which may facilitate abrasion of non-continuous abradable coating 32 in blade rub portion 32*c* by blade 26. In a similar manner, the relatively small first and/or second average coating pitches $P_1$, $P_2$ may result in first and/or second portions 32*a*, 32*b* of non-continuous abradable coating 32 being denser than blade rub portion 32*c*. In turn, first portion 32*a* and/or second portion 32*b* may reduce leakage, provide increased protection to substrate 12, increase erosion resistance, or the like. In turn, non-continuous abradable coating 32 with at least one of first or second plurality of coating blocks 34, 36 different than the third plurality of coating blocks 38 in average pitch between coating blocks may enable first and second portions 32*a*, 32*b* to have reduced leakage, increased protection, increased erosion resistance, or the like, while also enabling blade rub portion 32*c* to exhibit improved abradability.

In addition to, or as an alternative to, average coating block size or average pitch between coating blocks, at least one of first portion 32*a* or second portion 32*b* may differ from blade rub portion 32*c* in another coating block parameter. For example, the coating blocks of first and/or second portion 32*a*, 32*b* may differ from the coating blocks of blade rub portion 32*c* in at least one of a surface area, a perimeter length, a contour shape, or orientation of the coating blocks.

Figure 3:
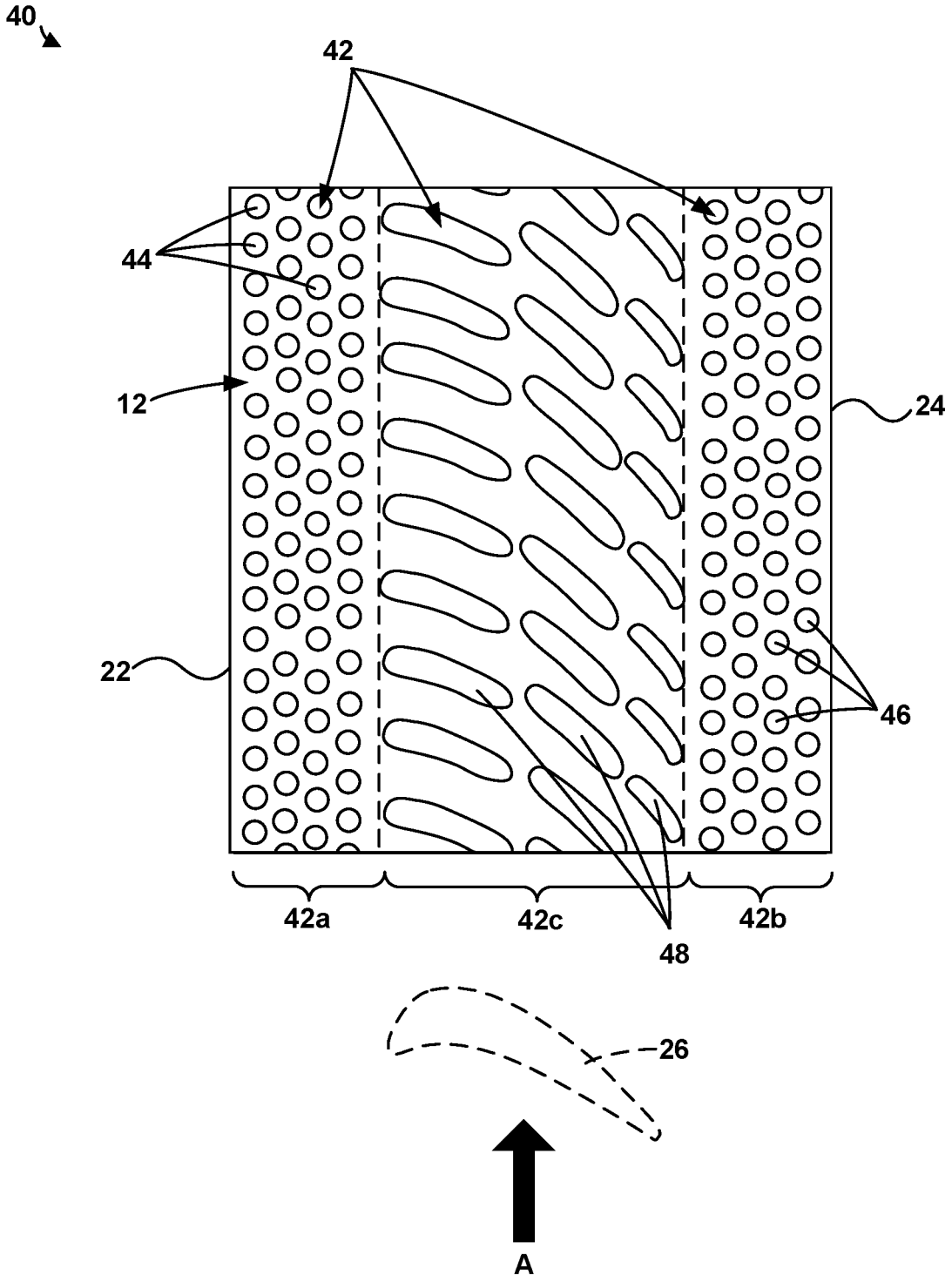
FIG. 3 is a conceptual diagram illustrating a top view of an example component including a non-continuous abradable coating that includes a first plurality of coating blocks and second plurality of coating blocks that differ from a third plurality of coating blocks in block shape.

FIG. 3 is a conceptual diagram illustrating a top view of an example component 40 including a non-continuous abradable coating 42 that includes a first plurality of coating blocks 44 and a second plurality of coating blocks 46 that differ from a third plurality of coating blocks 48, for example, in block shape. Non-continuous abradable coating 42 may be substantially similar to non-continuous abradable coating 14 of FIG. 1 or non-continuous abradable coating 32 of FIG. 2 in composition and one or more block parameters. For instance, non-continuous abradable coating 42 may be the same or substantially the same as non-continuous abradable coating 14 or 32, except for the respective coating block parameter in which the coating blocks of a first portion 42*a* and/or a second portion 42*b* of non-continuous abradable coating 42 differs from the coating blocks of a blade rub portion 42*c*. For example, in the example of FIG. 1, at least one of the first and second pluralities of coating blocks 16, 18 differ from the third plurality of coating blocks 20 of blade rub portion 14*c* in average coating block size, and in the example of FIG. 2, at least one of the first and second pluralities of coating blocks 34, 36 differ from the third plurality of coating blocks 38 of blade rub portion 14*c* in average pitch between coating blocks. In the example of FIG. 3, at least one of first plurality of coating blocks 44 of a first portion 42*a* or second plurality of coating blocks 46 of a second portion 42*b* differ from third plurality of coating blocks 48 of a blade rub portion 42*c* in at least one of a surface area, a perimeter length, a contour shape, or orientation of the respective coating blocks of the plurality of coating blocks 44, 46, 48.

For example, each coating block of first plurality of coating blocks 44 may define a first shape, each coating block of second plurality of coating blocks 46 may define a second shape, and each coating block of third plurality of coating blocks 48 may define a third shape, and each coating block defining each of the first shape, second shape, or third shape may define a surface area, a perimeter length, and a contour shape. In some examples, at least one of the first or second shape may be different than the third shape in at least one of the respective surface area, perimeter length, or contour shape. In some examples, the respective coating blocks of at least one of first plurality of coating blocks 44, second plurality of coating blocks 46, or third plurality of coating blocks 48 may define more than one shape. For example, as illustrated in FIG. 3, the coating blocks of third plurality of coating blocks 48 defines three different shapes. Thus, in some such examples, at least one shape defined by the first or second plurality of coating blocks 44, 46 may be different from at least one shape defined by the third plurality of coating blocks 48 in surface area, perimeter length, and/or contour shape. As shown in FIG. 3, each of the three shapes defined by the third plurality of coating blocks 48 is different in surface area, perimeter length, and contour shape from the respective shapes of the first and second pluralities of coating blocks 44, 46. In other examples, only one or two of the three shapes defined by the third plurality of coating blocks 48 may be different in surface area, perimeter length, and/or contour shape from the respective shapes of the first and second pluralities of coating blocks 44, 46. Moreover, in some examples, the first plurality of coating blocks 44 or the second plurality of coating blocks 46 may define more than one shape, and at least one of the respective shapes defined by the first or second plurality of coating blocks 44, 46 may be different than at least one shape defined by the third plurality of coating blocks 48. In other words, at least one of the surface area, perimeter length, or contour shape of at least one shape of the respective coating blocks of the first and/or second plurality of coating blocks 44, 46 may be different from at least one of the surface area, perimeter length, or contour shape of at least one shape of the respective coating blocks of the third plurality of coating blocks 48.

In some examples, the respective coating blocks of the first, second, or third plurality of coating blocks 44, 46, 48 may be aligned along a predetermined orientation. For example, in some cases, the coating blocks of the third plurality of coating blocks 48 may be oriented to substantially align with blade 26. In the example illustrated in FIG. 3, the third plurality of coating blocks 48 of blade rub portion 42*c* are oriented to substantially align with blade 26. Aligning the third plurality of coating blocks 48 of blade rub portion 42*c* may make blade rub portion 42*c* more easily abraded by blade 26. For example, aligning the plurality of coating blocks 48 with a leading edge of blade 26 may enable the blade 26 to more easily cut through the respective coating blocks. In some examples, orienting the third plurality of coating blocks 48 of blade rub portion 42*c* to substantially align with blade 26 configured to contact blade rub portion 42*c* upon rotation of blade 26 in the circumferential direction (e.g., in the direction of arrow A) may help prevent blade 26 from abruptly or unevenly contacting coating blocks of the third plurality of coating blocks 48, which may reduce the bending load on blade 26 upon contact with the respective coating blocks, enable blade 26 to push or abrade the respective coating blocks 48 more efficiently, or the like. In contrast, a plurality of coating blocks that are not oriented to substantially align with blade 26, such as a plurality of coating blocks that are oriented substantially perpendicular to the leading edge of blade 26, may result in the blade rub portion being more difficult to abrade, increased stress on blade 26, less efficient abrasion of the blade rub portion, or the like in comparison to the third plurality of coating blocks 48 that are oriented to substantially align with blade 26 (e.g., are oriented relatively parallel to the leading edge of blade 26).

As described herein, at least one of the first plurality of coating blocks 44 or the second plurality of coating blocks 46 may be different than the third plurality of coating blocks 48 in at least one coating block parameter, such as, for example, average coating block size, average pitch between coating blocks, coating block shape, or coating block orientation. In this way, different portions 42*a*-42*c* of non-continuous abradable coating 42 can exhibit different properties. In some examples, it may be desirable for first and second portions 42*a*, 42*b* to have reduced leakage, increased protection, increased erosion resistance, or the like, and for blade rub portion 42*c* to have improved abradability. Therefore, the at least one coating parameter of first and/or second plurality of coating blocks 44, 46 different from the third plurality of coating blocks 48 may contribute to the different properties exhibited by the respective portions 42*a*-42*c*. For example, coating block parameters configured to increase the tortuosity, increase an overall density, decrease a size of spacings between coating blocks, or the like of first and/or second portions 42*a*, 42*b* may contribute to reduced leakage, increased protection, and/or increased erosion resistance of first and/or second portions 42*a*, 42*b*. On the other hand, coating block parameters configured to decrease an overall density, increase an average coating block size, reduce stress on blade 26, increase a size of spacings between coating blocks, align with blade 26, improve the pushability of the respective coating blocks, or the like of first and/or second portions 42*a*, 42*b* may contribute to improved abradability of blade rub portion 42*c*. Thus, any combination of coating block parameters in accordance with the disclosure may be used to form non-continuous abradable coating 42.

FIG. 4 is a conceptual diagram illustrating a side view of an example system 50 including a blade 26 and a component 52 that includes a substrate 12 and a non-continuous abradable coating 54 on substrate 12. Non-continuous abradable coating 54 may be substantially similar to non-continuous abradable coating 14 of FIG. 1, non-continuous abradable coating 32 of FIG. 2, or non-continuous abradable coating 42 of FIG. 3. For example, a first plurality of coating blocks 56, a second plurality of coating blocks 58, and a third plurality of coating blocks 60 may be the same or substantially the same as the respective first, second, and third pluralities of coating blocks of non-continuous abradable coating 14, 32, or 42. Thus, for brevity, the details of non-continuous abradable coating 54 will not be repeated with respect to FIG. 4. In other examples, however, non-continuous abradable coating 54 may include a different non-continuous abradable coating in accordance with the disclosure (e.g., a non-continuous abradable coating other than non-continuous abradable coating 14, 32, or 42).

In some examples, non-continuous abradable coating 54 may be a first abradable coating, and component 52 may include a second abradable coating 62. For example, component 52 may include second abradable coating 62 on substrate 12. In some such examples, second abradable coating 62 may be between adjacent coating blocks of at least one of the first plurality of coating blocks 56, the second plurality of coating blocks 58, or the third plurality of coating blocks 60 of non-continuous abradable coating 54. In the example of FIG. 4, second abradable coating 62 is between adjacent coating blocks of all of the first plurality of coating blocks 56, the second plurality of coating blocks 58, and the third plurality of coating blocks 60 of non-continuous abradable coating 54. In other examples, one or more of the first plurality of coating blocks 56, the second plurality of coating blocks 58, or the third plurality of coating blocks 60 of non-continuous abradable coating 54 may not include second abradable coating 62 between the respective adjacent coating blocks. For instance, in some cases, a first portion of non-continuous abradable coating 54 including the first plurality of coating blocks 56 and a second portion including the second plurality of coating blocks 58 may include second abradable coating 62 between adjacent coating blocks, and a blade rub portion including the third plurality of coating blocks 60 may not include second abradable coating 62. In any case, component 52 including second abradable coating 62 within at least some spacings between adjacent coating blocks of the first, second, and/or third plurality of coating blocks 56, 58, 60 may reduce leakage, improve erosion resistance, reduce stress of component 52, or combinations thereof. Additionally, or alternatively, component 52 may include second abradable coating 62 on non-continuous abradable coating 54 (e.g., on respective coating blocks of the first, second, and/or third plurality of coating blocks 56, 58, 60).

Second abradable coating 62 may include any suitable material. For example, second abradable coating 62 may include may material described above with respect to non-continuous abradable coating 14. Thus, in some cases, second abradable coating 62 may have the same or substantially the same composition as non-continuous abradable coating 54. In other examples, second abradable coating 62 may have a different composition than non-continuous abradable coating 54.

As described above with respect to non-continuous abradable coating 14, second abradable coating 62 may include a plurality of pores, such as, for example, at least one of interconnected voids, unconnected voids, partly connected voids, spheroidal voids, ellipsoidal voids, irregular voids, or voids having any predetermined geometry, or networks thereof. In some examples, such as examples in which second abradable coating 62 is between adjacent coating blocks of the first plurality of coating blocks 56, the second plurality of coating blocks 58, and/or the third plurality of coating blocks 60 and not on non-continuous abradable coating 54 (e.g., such that second abradable coating 62 is also substantially non-continuous), the porosity of second abradable coating 62 may be measured as a percentage of pore volume divided by total volume of the respective non-continuous block between the respective coating blocks of non-continuous abradable coating 54. In other examples, such as examples in which second abradable coating 62 is relatively continuous, the porosity of second abradable coating 62 may be measured as a percentage of pore volume divided by total volume of second abradable coating 62.

In some examples, second abradable coating 62 may have a relatively higher porosity (e.g., may be less dense) than the respective coating blocks of non-continuous abradable coating 54. Second abradable coating 62 having a relatively high porosity may result in component 52 having improved erosion resistance, improved protection, and/or reduced leakage, while maintaining improved thermal cycling resistance and decreased stress. For example, the relatively high porosity of second abradable coating 62 between adjacent coating blocks of non-continuous abradable coating 54 may be able to still accommodate thermal expansion of the respective coating blocks, which may reduce thermal stress in comparison to a continuous abradable coating or a second abradable coating with a relatively low porosity.

In some cases, component 52 may have one or more additional coating layers on substrate. For example, component 52 may include a bond coat 64 and/or an intermediate coating 66 on substrate 12. In some such examples, non-continuous abradable coating 54, second abradable coating 62, or both may be on one or both of bond coat 54 or intermediate coating 66 such that bond coat 64 and/or intermediate coating 66 are between substrate 12 and the abradable coatings 54, 62. As described herein, spacings between adjacent coating blocks of the respective first, second, and third plurality of coating blocks 56, 58, 60 may extend though an entire thickness of non-continuous abradable coating 54. In such examples, the spacings between each respective coating block of the first, second, and third plurality of coating blocks 56, 58, 60 and respective adjacent coating blocks may not extend through any part of a layer underlying non-continuous abradable coating 54, such as intermediate coating 66 or bond coat 64. In some such examples, substrate 12 may be better protected by intermediate coating 66 or bond coat 64 in comparison to components in which the spacings extend from non-continuous abradable coating 54 to substrate 12 through intermediate coating 66 and/or bond coat 64.

Component 52 including bond coat 64 may improve adhesion between substrate 12 and an overlying layer, such as intermediate coating 66. The bond coat may include any suitable material configured to improve adhesion between substrate 12 and the overlaying layer. In some examples, component 52 may not include intermediate coating 66 such that non-continuous abradable coating 54 and/or second abradable coating 62 is on bond coat 64. In such examples, the composition of bond coat 64 may be selected to increase adhesion between substrate 12 and non-continuous abradable coating 54 and/or second abradable coating 62.

In examples in which substrate 12 includes a superalloy, bond coat 64 may include an alloy, such as an MCrAlY alloy (where M is Ni, Co, or NiCo), a β-NiAl nickel aluminide alloy (either unmodified or modified by Pt, Cr, Hf, Zr, Y, Si, or combinations thereof), a γ-Ni+γ'-$Ni_3Al$ nickel aluminide alloy (either unmodified or modified by Pt, Cr, Hf, Zr, Y, Si, or combinations thereof), or the like. In examples in which substrate 12 includes a ceramic or CMC, bond coat 64 may include a ceramic or another material that is compatible with the material from which substrate 12 is formed. For example, bond coat 64 may include mullite (aluminum silicate, $Al_6Si_2O_{13}$), silicon metal or alloy, silica, a silicide, or the like. Bond coat 64 may further include other elements, such as a rare earth silicate including a silicate of lutetium (Lu), ytterbium (Yb), thulium (Tm), erbium (Er), holmium (Ho), dysprosium (Dy), gadolinium (Gd), terbium (Tb), europium (Eu), samarium (Sm), promethium (Pm), neodymium (Nd), praseodymium (Pr), cerium (Ce), lanthanum (La), yttrium (Y), and/or scandium (Sc).

In some examples, intermediate coating 66 may include at least one of an environmental barrier coating (EBC) layer or a thermal barrier coating (TBC) layer. In some examples, a single intermediate coating 66 may perform two or more of these functions. For example, an EBC layer may provide environmental protection, thermal protection, and calcia-magnesia-alumina-silicate (CMAS)-resistance to substrate 12. In some examples, instead of including a single intermediate coating 66, component 52 may include a plurality of intermediate coatings, such as at least one bond coat 64, at least one EBC layer, at least one TBC layer, or combinations thereof.

In examples in which intermediate coating 66 includes an EBC layer, the EBC layer may include at least one of a rare-earth oxide, a rare-earth silicate, an aluminosilicate, or an alkaline earth aluminosilicate. For example, an EBC layer may include mullite, barium strontium aluminosilicate (BSAS), barium aluminosilicate (BAS), strontium aluminosilicate (SAS), at least one rare-earth oxide, at least one rare-earth monosilicate ($RE_2SiO_5$, where RE is a rare-earth element), at least one rare-earth disilicate ($RE_2Si_2O_7$, where RE is a rare-earth element), or combinations thereof. The rare-earth element in the at least one rare-earth oxide, the at least one rare-earth monosilicate, or the at least one rare-earth disilicate may include at least one of Lu, Yb, Tm, Er, Ho, Dy, Tb, Gd, Eu, Sm, Pm, Nd, Pr, Ce, La, Y, or Sc.

In some examples, an EBC layer may include at least one rare-earth oxide and alumina, at least one rare-earth oxide and silica, or at least one rare-earth oxide, silica, and alumina. In some examples, an EBC layer may include an additive in addition to the primary constituents of the EBC layer. For example, the additive may include at least one of $TiO_2$, $Ta_2O_5$, $HfSiO_4$, an alkali metal oxide, or an alkali earth metal oxide. The additive may be added to the EBC layer to modify one or more desired properties of the EBC layer. For example, the additive components may increase or decrease the reaction rate of the EBC layer with CMAS, may modify the viscosity of the reaction product from the reaction of CMAS and the EBC layer, may increase adhesion of the EBC layer to substrate 12 and/or another coating layer, may increase or decrease the chemical stability of the EBC layer, or the like.

In some examples, the EBC layer may be substantially free (e.g., free or nearly free) of hafnia and/or zirconia. Zirconia and hafnia may be susceptible to chemical attack by CMAS, so an EBC layer substantially free of hafnia and/or zirconia may be more resistant to CMAS attack than an EBC layer that includes zirconia and/or hafnia. An EBC layer may be a substantially dense layer, e.g., may include a porosity of less than about 10 vol. %, measured as a fraction of open space compared to the total volume of the EBC layer using, for example, mercury porosimetry, optical microscopy, a method based on Archimedes' principle, e.g., a fluid saturation technique, or the like. The EBC layer may also provide resistance to CMAS.

Additionally, or alternatively, intermediate coating 66 may include a TBC layer. The TBC layer may have a low thermal conductivity (e.g., both an intrinsic thermal conductivity of the material(s) that forms the TBC layer and an effective thermal conductivity of the TBC layer as constructed) to provide thermal insulation to substrate 12 and/or another coating layer of intermediate coating 66. In some examples, a TBC layer may include a zirconia- or hafnia-based material, which may be stabilized or partially stabilized with one or more oxides. In some examples, the inclusion of rare-earth oxides such as ytterbia, samaria, lutetia, scandia, ceria, gadolinia, neodymia, europia, yttria-stabilized zirconia (YSZ), zirconia stabilized by a single or multiple rare-earth oxides, hafnia stabilized by a single or multiple rare-earth oxides, zirconia-rare-earth oxide compounds, such as $RE_2Zr_2O_7$ (where RE is a rare-earth element), hafnia-rare-earth oxide compounds, such as $RE_2Hf_2O_7$ (where RE is a rare-earth element), and the like may help decrease the thermal conductivity of the TBC layer. In some examples, a TBC layer may include a base oxide including zirconia or hafnia, a first rare earth oxide including ytterbia, a second rare earth oxide including samaria, and a third rare earth oxide including at least one of lutetia, scandia, ceria, neodymia, europia, or gadolinia. A TBC layer may include porosity, such as a columnar or microporous microstructure, which may contribute to relatively low thermal conductivity of the TBC layer.

Bond coat 64 and/or intermediate coating 66 may be formed on substrate 12 using, for example, thermal spraying, e.g., air plasma spraying, high velocity oxy-fuel (HVOF) spraying, low vapor plasma spraying, suspension plasma spraying; physical vapor deposition (PVD), e.g., electron beam physical vapor deposition (EB-PVD), directed vapor deposition (DVD), cathodic arc deposition; chemical vapor deposition (CVD); slurry process deposition; sol-gel process deposition; electrophoretic deposition; or the like.

Non-continuous abradable coatings 14, 32, 42, 54 may be applied to substrate 12 using a thermal spraying technique, such as plasma spraying. Non-continuous abradable coatings 14, 32, 42, 54 may define a relatively large thickness, such as up to about 2 millimeters (mm) or more. As such, abradable coatings may be applied using multiple passes of the thermal spraying device. For each pass, the thermal spraying device deposits a layer of material on the substrate (or an underlying layer). This deposited layer then begins to cool, and an additional layer is deposited on the cooling layer. This results in residual stress in the abradable coating. This residual stress reduces bond strength of the abradable coating to an underlying layer and may result in spallation or cracking of the non-continuous abradable coating upon being used in a high temperature environment. This issue with residual stress may be exacerbated in examples in which non-continuous abradable coating 14, 32, 42, 54 is applied to a continuous blade track or shroud. However, spacings between adjacent coating blocks in the non-continuous abradable coating 14, 32, 42, 54 may reduce strain within the non-continuous abradable coating 14, 32, 42, 54 at an interface between the non-continuous abradable coating 14, 32, 42, 54 and an underlying layer (e.g., intermediate coating 66, bond coat 64, or substrate 12), thus increasing bond strength and reducing a likelihood of cracking, spallation, or both.

In some examples, the spacings between adjacent coating blocks of non-continuous abradable coating 14, 32, 42, 54 may be formed in non-continuous abradable coating 14, 32, 42, 54 by mechanical removal of portions of abradable coating material after deposition of the abradable coating material on substrate 12. However, in some examples, this may not efficiently reduce residual stress in non-continuous abradable coating 14, 32, 42, 54. Hence, in some examples, the spacings between adjacent coating blocks may be defined in non-continuous abradable coating 14, 32, 42, 54 as part of forming non-continuous abradable coating 14, 32, 42, 54.

Figure 5:
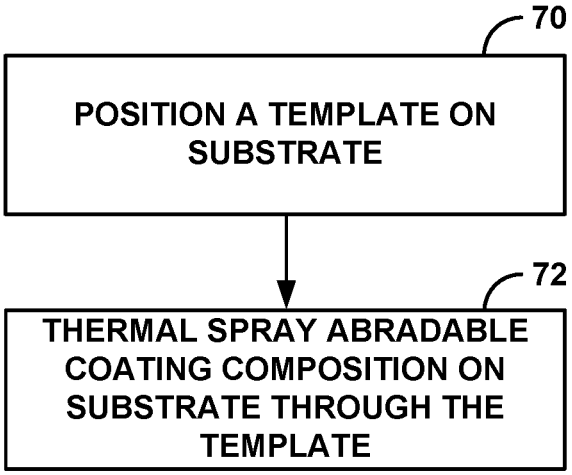
FIG. 5 is a flow diagram illustrating an example technique for forming a non-continuous abradable coating on a substrate.
Figure 6A:
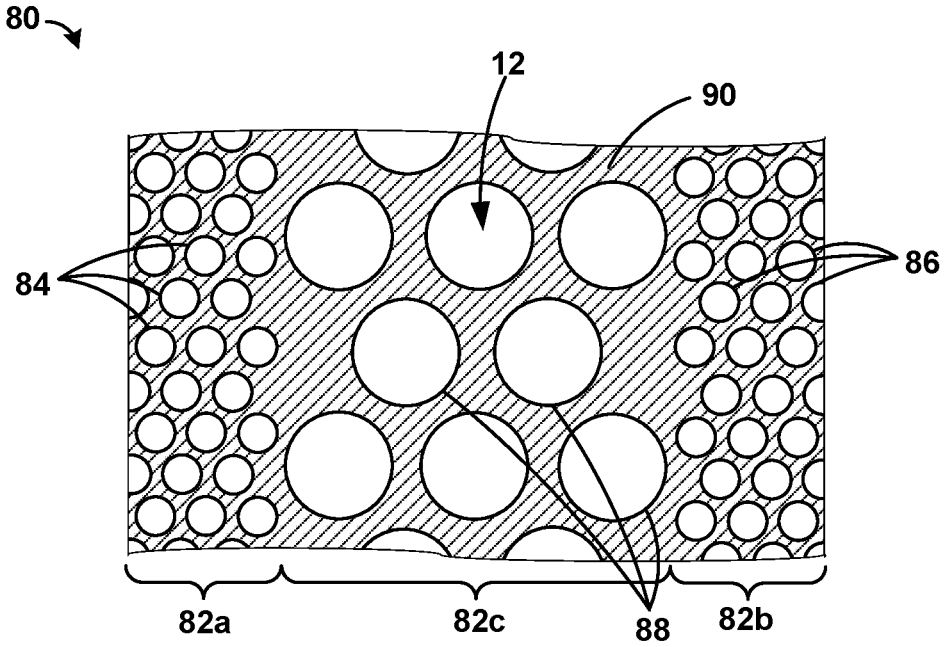
FIGS. 6A to 6C are conceptual diagrams illustrating stages of the example technique of FIG. 5 for forming a non-continuous abradable coating on a substrate.
Figure 6B:
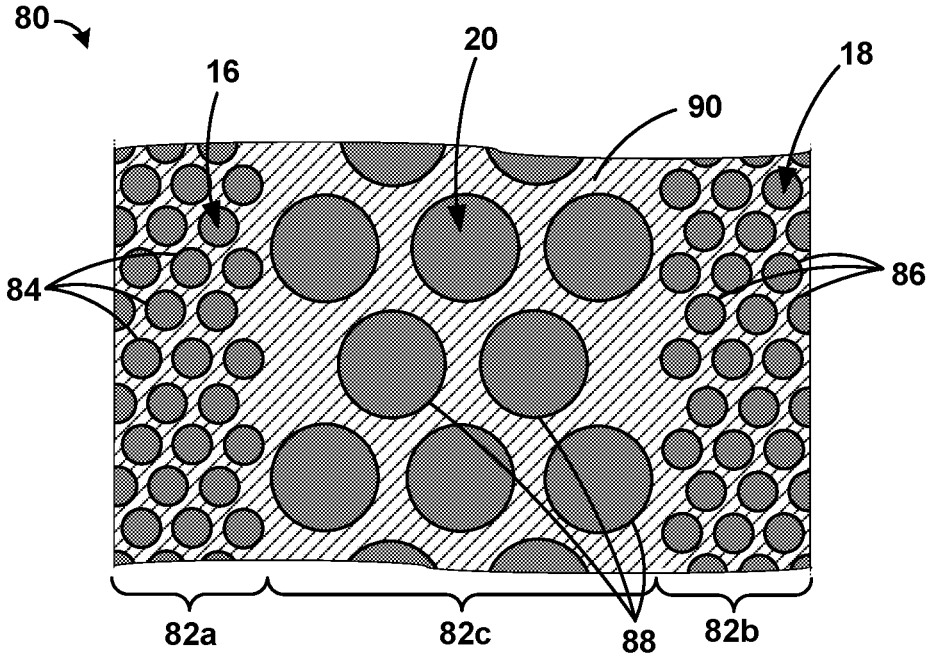
Figure 6C:
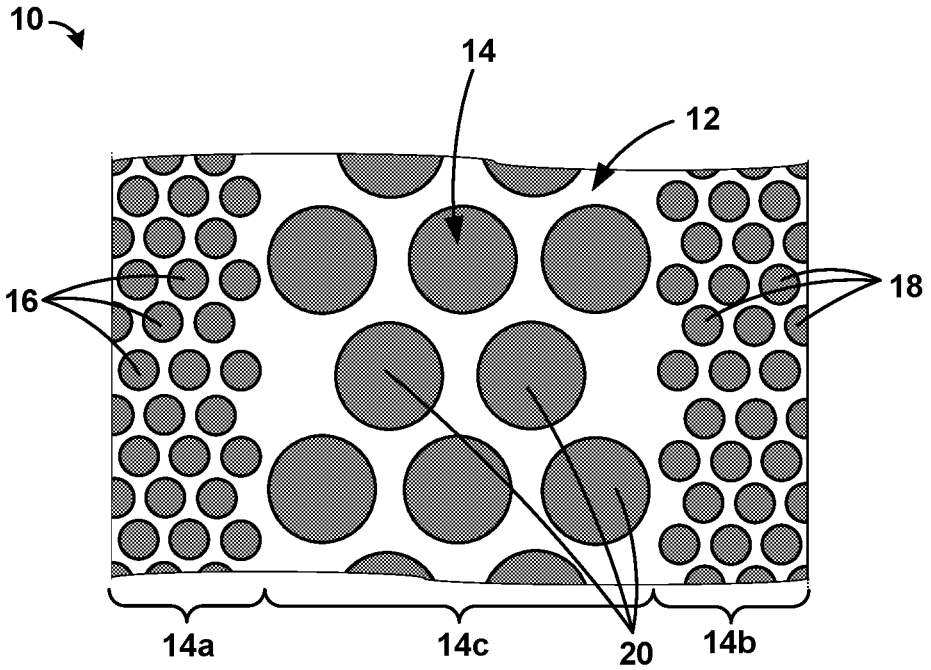

FIG. 5 is a flow diagram illustrating an example technique for forming a non-continuous abradable coating on a substrate. FIGS. 6A to 6C are conceptual diagrams illustrating stages of the example technique of FIG. 5 for forming a non-continuous abradable coating on a substrate. The technique of FIG. 5 will be described with respect to component 10 of FIG. 1 and the stages illustrated in FIGS. 6A to 6C for ease of description only. In other examples, the technique of FIG. 5 may be used to form components other than component 10 of FIG. 1 (e.g., component 30, 40, 52 of FIGS. 2 to 4), or another technique may be used to from components 10, 30, 40, 52.

In some examples, the technique of FIG. 5 may be performed on a pre-machined substrate, for example substrate 12 pre-machined or otherwise fabricated. The example technique of FIG. 5 may optionally include depositing bond coat 64 on substrate 12, depositing intermediate coating 66 on substrate 12, or both. One or both of depositing of bond coat 64 or depositing of intermediate coating 66 may include at least one of thermal spraying, plasma spraying, physical vapor deposition, chemical vapor deposition, or any other suitable technique.

The example technique of FIG. 5 includes positioning a template 80 on substrate 12 (70). In some examples, template 80 includes a separator 90 that defines positions at which coating material will not be deposited onto the underlying substrate 12, and leaves portions of substrate 12 exposed. In this way, the position of separator 90 defines the position of the spacings between coating blocks of non-continuous abradable coating 14. In the example shown in FIG. 6A, template 80 includes separator 90 that defines a first portion 82*a* defining a first plurality of coating block cells 84, a second portion 82*b* defining a second plurality of coating block cells 86, and a blade rub portion 82*c* extending between first portion 82*a* and second portion 82*b* and defining a third plurality of coating block cells 88. The first plurality of coating block cells 84, second plurality of coating block cells 86, and third plurality of coating block cells 88 may form the first plurality of coating blocks 16, the second plurality of coating blocks 18, and the third plurality of coating blocks 20, respectively, of non-continuous abradable coating 14. Although the technique of FIG. 5 is described with respect to a single template 80 being used to form non-continuous abradable coating 14, in other examples more than one template may be used to form non-continuous abradable coating 14. For example, a different template may be used to form each portion 14*a* to 14*c* of non-continuous abradable coating 14.

In the example of FIG. 6A, each of the first, second, and third plurality of coating block cells 84, 86, 88 define circular contour shapes, with separator 90 defining the border between adjacent coating block cells. In other examples in which the coating blocks cells have other contour shapes, separator 90 of template 80 may define any suitable shape of the first, second, and third coating block cells 84, 86, 88 corresponding the contour shape of the coating blocks of the respective plurality of coating blocks 16, 18, 20 of non-continuous abradable coating 14 to be formed using template 80.

Template 80 may be formed of any suitable material, e.g., any material that substantially maintains its shape at temperatures experienced by template 80 during thermal spraying of non-continuous abradable coating 14. For example, the material from which template 80 is formed may be capable of withstanding a temperature of about 250° C. Example materials for template 80 may include a silicone rubber, a polyimide, a polyamide, a fluoropolymer, a metal, or the like. In some examples, template 80 may be formed using a molding process, in which template 80 is initially formed using a negative mold. The negative mold may define voids corresponding to the shape of template 80. In some examples, the mold additionally may define one or more features for positioning template 80 relative to substrate 12, restraining template 80 relative to substrate 12, or both. For example, the mold may define one or more straps, bands, hooks, or the like to facilitate positioning template 80 relative to substrate 12, restraining template 80 relative to substrate 12, or both. In some examples, the mold may be formed by 3D printing (or additive manufacturing) a suitable mold material.

In some examples, rather than forming template 80 using molding, template 80 may be 3D printed (or additively manufactured) using a suitable high-temperature material, such as a silicone rubber, a polyimide, a polyamide, a fluoropolymer, a metal, or the like.

In some implementations, template 80 may be adhered to the surface of substrate 12 (or bond coat 64 or intermediate coating 66) using a high temperature adhesive. In other implementations, adhesion between template 80 and the surface of substrate 12 (or bond coat 64 or intermediate coating 66) may be sufficiently high that the adhesive may be omitted.

Once template 80 has been positioned on substrate 12 (70), the technique of FIG. 5 includes thermal spraying an abradable coating composition through template 80 to cause the abradable coating composition to deposit on substrate 12 as non-continuous abradable coating 14 (72). The thermal spraying (72) may include any spraying technique suitable for spraying at least one precursor composition to form non-continuous abradable coating 14 including an abradable composition as described herein, for example, plasma spraying, high velocity oxygen fuel (HVOF) spraying, or wire arc spraying. The thermal spraying (72) may include introducing the at least one precursor composition into an energized flow stream (for example, an ignited plasma stream) to result in at least partial fusion or melting of the precursor composition, and directing or propelling the precursor composition toward substrate 12. The propelled precursor composition impacts exposed portions of substrate 12 to form the respective first, second, and third pluralities of coating blocks 16, 18, 20 of non-continuous abradable coating 14, as shown in FIG. 6B.

One or more of the spray duration, spray flow rate, or number of passes at a given location may determine the thickness of the respective coating blocks of the first, second, and third pluralities of coating blocks 16, 18, 20 deposited by thermal spraying. For example, an increase in the duration, in the flow rate, or the number of passes may increase the thickness of the respective coating blocks of the first, second, and third pluralities of coating blocks 16, 18, 20, while a reduction in the duration, flow rate, or number of passes may maintain the thickness of the respective coating blocks of the first, second, and third pluralities of coating blocks 16, 18, 20 below or at a predetermined thickness.

In some examples, the at least one precursor composition may be suspended or dispersed in a carrier medium, for example, a liquid or a gas. The precursor composition may also include an additive as described herein configured to define pores in the respective coating blocks in response to thermal treatment. In some examples, the additive may be sacrificially removed in response to heat subjected by the thermal spraying, or by a separate heat treatment. For example, the technique of FIG. 5 may optionally include heat treating of the respective coating blocks of the first, second, and third pluralities of coating blocks 16, 18, 20 after deposition of non-continuous abradable coating 14 on substrate 12.

The heat treating may result in removal or disintegration of the additive to leave pores in the respective coating blocks of the first, second, and third pluralities of coating blocks 16, 18, 20. The heat treatment may be at a temperature of between about 600° C. and about 700° C. In other examples, the technique of FIG. 5 may omit the heat treating, and the additive may burn off or otherwise be removed upon use of substrate 12 at high temperature. In some examples, heat treating may, instead of, or in addition to, removing the additive, may also change the physical, chemical, mechanical, material, or metallurgical properties of at least one layer of the respective coating blocks of the first, second, and third pluralities of coating blocks 16, 18, 20. For example, the heat treating may anneal at least one layer of the respective coating blocks of the first, second, and third pluralities of coating blocks 16, 18, 20 formed by the thermal spraying, resulting in an increase in strength or integrity of the respective coating blocks of the first, second, and third pluralities of coating blocks 16, 18, 20 compared to unannealed coating blocks of non-continuous abradable coating 14.

In some examples, the heat treating additionally may cause removal of template 80, e.g., via burning off, melting, or the like. In other examples, template 80 may be removed from substrate 12 in another manner 12. For instance, template 80 may burn off or otherwise be removed upon use of substrate 12 at high temperature. As another example, template 80 may be mechanically removed from substrate 12. In any case, the removal of template 80 from substrate 12 leaves non-continuous abradable coating 14 including first portion 14*a* defining first plurality of coating blocks 16, second portion 14*b* defining second plurality of coating blocks 18, and blade rub portion 14*c* extending between first portion 14*a* and second portion 14*c* and defining third plurality of coating blocks 20, as shown in FIG. 6C. As described herein, at least one of the first plurality of coating blocks 16 or the second plurality of coating blocks 18 is different than the third plurality of coating blocks 20 in at least one coating block parameter.

Example systems and techniques according to the disclosure may be used to prepare example non-continuous abradable coatings.

Various examples have been described. These and other examples are within the scope of the following claims.

What is claimed is:

1. A component comprising:

a substrate; and a non-continuous abradable coating on the substrate, wherein the non-continuous abradable coating comprises:

a first portion defining a first plurality of coating blocks, wherein each individual coating block of the first plurality of coating blocks comprises a discrete first block of a first material extending away from a surface of the substrate and spaced apart from adjacent first blocks of the first plurality of coating blocks relative to the surface of the substrate, a second portion defining a second plurality of coating blocks, wherein each individual coating block of the second plurality of coating blocks comprises a discrete second block of a second material extending away from the surface of the substrate and spaced apart from adjacent second blocks of the second plurality of coating blocks relative to the surface of the substrate, and a blade rub portion extending between the first portion and the second portion and defining a third plurality of coating blocks, wherein each individual coating block of the third plurality of coating blocks comprises a discrete third block of a third material extending away from the surface of the substrate and spaced apart from adjacent third blocks of the third plurality of coating blocks relative to the surface of the substrate, and wherein at least one of the first plurality of coating blocks or the second plurality of coating blocks is different than the third plurality of coating blocks in at least one coating block parameter, and wherein the first plurality of coating blocks defines individual coating blocks of a first average size, the second plurality of coating blocks defines individual coating blocks of a second average size, and the third plurality of coating blocks defines individual coating blocks of a third average size, wherein the third average size is different from at least one of the first average size or the second average size.

2. The component of claim 1, wherein the discontinuous coating is configured such that a spacing between each respective individual coating block of the first, second, and third plurality of coating blocks and respective adjacent individual coating blocks defines an open gap that extends through an entire thickness of the non-continuous abradable coating.

3. The component of claim 1, wherein the discontinuous coating is configured such that a spacing between each respective individual coating block of the first, second, and third plurality of coating blocks and respective adjacent individual coating blocks defines an open gap that does not extend through any part of a layer underlying the non-continuous abradable coating.

4. The component of claim 1, wherein at least one of the first average size or the second average size is less than the third average size.

5. The component of claim 1, wherein the first plurality of coating blocks defines a first average pitch between individual coating blocks, the second plurality of coating blocks defines a second average pitch between individual coating blocks, and the third plurality of coating blocks defines a third average pitch between individual coating blocks, wherein the third average pitch between coating blocks is different from at least one of the first average pitch or second average pitch between coating blocks.

6. The component of claim 5, wherein at least one of the first average pitch or the second average pitch is less than the third average pitch.

7. The component of claim 1, wherein each individual coating block of the first plurality of coating blocks defines a first shape, each individual coating block of the second plurality of coating blocks defines a second shape, and each individual coating block of the third plurality of coating blocks defines a third shape, and wherein the third shape is different from a least one of the first shape or the second shape in at least one of a surface area, a perimeter length, or a contour shape.

8. The component of claim 1, wherein respective individual coating blocks of the third plurality of coating blocks are oriented to substantially align with a blade tip of a blade configured to contact the blade rub portion upon rotation of the blade in a circumferential direction.

9. The component of claim 1, wherein the non-continuous abradable coating comprises a first abradable coating, wherein the component further comprises a second abradable coating on the substrate, and wherein the second abradable coating is between respective adjacent individual coating blocks of at least one of the first plurality of coating blocks, the second plurality of coating blocks, or the third plurality of coating blocks of the first abradable coating.

10. The component of claim 1, wherein the substrate comprises a ceramic matrix composite.

11. The component of claim 1, wherein the non-continuous abradable coating comprises at least one of aluminum nitride, aluminum diboride, boron carbide, aluminum oxide, mullite, zirconium oxide, carbon, silicon metal, silicon alloy, silicon carbide, silicon nitride, a transition metal nitride, a transition metal boride, a rare earth oxide, a rare earth silicate, a stabilized zirconium oxide, a stabilized hafnium oxide, or barium-strontium-aluminum silicate.

12. A system comprising:

the component of claim 1; and a blade tip configured to contact the blade rub portion of the non-continuous abradable coating with a portion of the blade tip.

13. The component of claim 1, wherein a composition of at least one of the first material the first plurality of coating blocks or the second material of the second plurality of coating blocks is different than the third material of the third plurality of coating blocks.

14. The component of claim 1, further comprising:

a bond coat on the substrate between the substrate and the discontinuous coating; and an environmental barrier coating on the substrate between the bond coat and the discontinuous coating, the environment barrier coating comprising a rare earth silicate.

15. The component of claim 1, further comprising:

a bond coat on the substrate between the substrate and the discontinuous coating; and a thermal barrier coating on the substrate between the bond coat and the discontinuous coating, the thermal barrier coating comprising at least one of hafnia or zirconia.

16. The component of claim 1, wherein the discontinuous coating is configured such that a spacing between each respective individual coating block of the first, second, and third plurality of coating blocks and respective adjacent individual coating blocks is at least partially filled with a material having a different composition than the first plurality of coating blocks, the second plurality of coating blocks, and the third coating blocks.

17. The component of claim 1, wherein the first material of the first plurality of coating blocks is the same as the second material of the second plurality of coating blocks.

18. A component comprising:

a substrate; and a non-continuous abradable coating on the substrate, wherein the non-continuous abradable coating comprises:

a first portion defining a first plurality of coating blocks, wherein each individual coating block of the first plurality of coating blocks comprises a discrete first block of a first material extending away from a surface of the substrate and spaced apart from adjacent first blocks of the first plurality of coating blocks relative to the surface of the substrate, a second portion defining a second plurality of coating blocks, wherein each individual coating block of the second plurality of coating blocks comprises a discrete second block of a second material extending away from the surface of the substrate and spaced apart from adjacent second blocks of the second plurality of coating blocks relative to the surface of the substrate, and a blade rub portion extending between the first portion and the second portion and defining a third plurality of coating blocks, wherein each individual coating block of the third plurality of coating blocks comprises a discrete third block of a third material extending away from the surface of the substrate and spaced apart from adjacent third blocks of the third plurality of coating blocks relative to the surface of the substrate, and wherein at least one of the first plurality of coating blocks or the second plurality of coating blocks is different than the third plurality of coating blocks in at least one coating block parameter, wherein the first plurality of coating blocks defines a first average pitch between individual coating blocks, the second plurality of coating blocks defines a second average pitch between individual coating blocks, and the third plurality of coating blocks defines a third average pitch between individual coating blocks, wherein the third average pitch between coating blocks is different from at least one of the first average pitch or second average pitch between coating blocks, and wherein at least one of the first average pitch or the second average pitch is less than the third average pitch.

19. A component comprising:

a substrate; and a non-continuous abradable coating on the substrate, wherein the non-continuous abradable coating comprises:

a first portion defining a first plurality of coating blocks, wherein each individual coating block of the first plurality of coating blocks comprises a discrete first block of a first material extending away from a surface of the substrate and spaced apart from adjacent first blocks of the first plurality of coating blocks relative to the surface of the substrate, a second portion defining a second plurality of coating blocks, wherein each individual coating block of the second plurality of coating blocks comprises a discrete second block of a second material extending away from the surface of the substrate and spaced apart from adjacent second blocks of the second plurality of coating blocks relative to the surface of the substrate, and a blade rub portion extending between the first portion and the second portion and defining a third plurality of coating blocks, wherein each individual coating block of the third plurality of coating blocks comprises a discrete third block of a third material extending away from the surface of the substrate and spaced apart from adjacent third blocks of the third plurality of coating blocks relative to the surface of the substrate, and wherein at least one of the first plurality of coating blocks or the second plurality of coating blocks is different than the third plurality of coating blocks in at least one coating block parameter, wherein a composition of at least one of the first material the first plurality of coating blocks or the second material of the second plurality of coating blocks is different than the third material of the third plurality of coating blocks.

20. A component comprising:

a substrate; and a non-continuous abradable coating on the substrate, wherein the non-continuous abradable coating comprises:

a first portion defining a first plurality of coating blocks, wherein each individual coating block of the first plurality of coating blocks comprises a discrete first block of a first material extending away from a surface of the substrate and spaced apart from adjacent first blocks of the first plurality of coating blocks relative to the surface of the substrate, a second portion defining a second plurality of coating blocks, wherein each individual coating block of the second plurality of coating blocks comprises a discrete second block of a second material extending away from the surface of the substrate and spaced apart from adjacent second blocks of the second plurality of coating blocks relative to the surface of the substrate, and a blade rub portion extending between the first portion and the second portion and defining a third plurality of coating blocks, wherein each individual coating block of the third plurality of coating blocks comprises a discrete third block of a third material extending away from the surface of the substrate and spaced apart from adjacent third blocks of the third plurality of coating blocks relative to the surface of the substrate, and wherein at least one of the first plurality of coating blocks or the second plurality of coating blocks is different than the third plurality of coating blocks in at least one coating block parameter, wherein the discontinuous coating is configured such that a spacing between each respective individual coating block of the first, second, and third plurality of coating blocks and respective adjacent individual coating blocks is at least partially filled with a material having a different composition than the first plurality of coating blocks, the second plurality of coating blocks, and the third coating blocks.

* * * * *